US008431887B2

(12) United States Patent
Flory et al.

(10) Patent No.: US 8,431,887 B2
(45) Date of Patent: Apr. 30, 2013

(54) CENTRAL LENS FOR CYLINDRICAL GEOMETRY TIME-OF-FLIGHT MASS SPECTROMETER

(75) Inventors: Curt A. Flory, Los Altos, CA (US); Trygve Ristroph, Fremont, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 121 days.

(21) Appl. No.: 13/017,101

(22) Filed: Jan. 31, 2011

(65) Prior Publication Data

US 2011/0180702 A1 Jul. 28, 2011

Related U.S. Application Data

(63) Continuation-in-part of application No. 12/415,915, filed on Mar. 31, 2009, now Pat. No. 7,919,748.

(51) Int. Cl.
*H01J 49/40* (2006.01)

(52) U.S. Cl.
USPC ..... 250/287

(58) Field of Classification Search ..... 250/287, 250/396 R
See application file for complete search history.

(56) References Cited

U.S. PATENT DOCUMENTS

| | | | | |
|---|---|---|---|---|
| 3,040,173 | A * | 6/1962 | Higatsberger | 250/293 |
| 3,949,221 | A | 4/1976 | Liebl | |
| 7,977,649 | B2 * | 7/2011 | Hirano | 250/396 R |
| 2008/0290269 | A1 * | 11/2008 | Saito et al. | 250/287 |
| 2010/0243886 | A1 | 9/2010 | Flory et al. | |
| 2012/0193524 | A1 | 8/2012 | Flory et al. | |

OTHER PUBLICATIONS

Bergmann, et al. "High-resolution time-of-flight mass spectrometers: Part I. Effects of field distortions in the vicinity of wire meshes." Rev. Sci. Instrum. 60 (3), Mar. 1989.

Wiley, et al. "Time-of-Flight Mass Spectrometer with Improved Resolution" Rev. Sci. Instrum. 26 (12), Dec. 1955.

* cited by examiner

*Primary Examiner* — Kiet T Nguyen

(57) ABSTRACT

A mass analyzer comprises a pair of planar electrode structures. The electrode structures are disposed opposite to each other, parallel to each other, and axially offset from each other. The electrode structures are configured to generate, in response to an applied voltage, a cylindrically-symmetric, annular electric field comprising an annular radially focusing central lens region surrounding an axis of symmetry, and an annular mirror region surrounding the annular radially focusing central lens region.

20 Claims, 25 Drawing Sheets

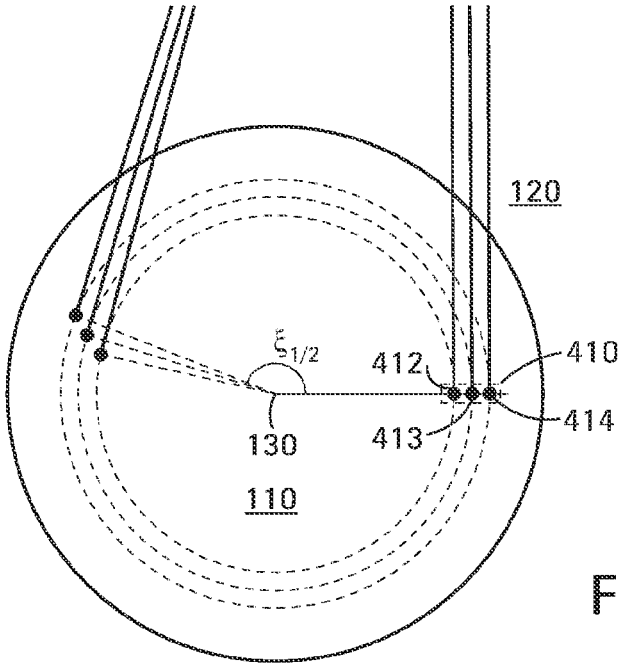
FIG.4B
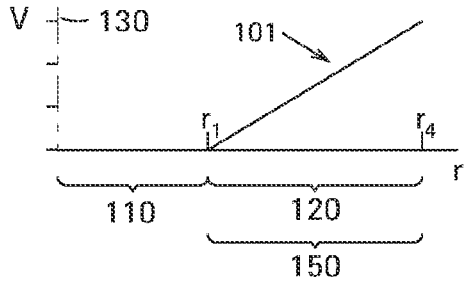
FIG.4A
FIG.4C
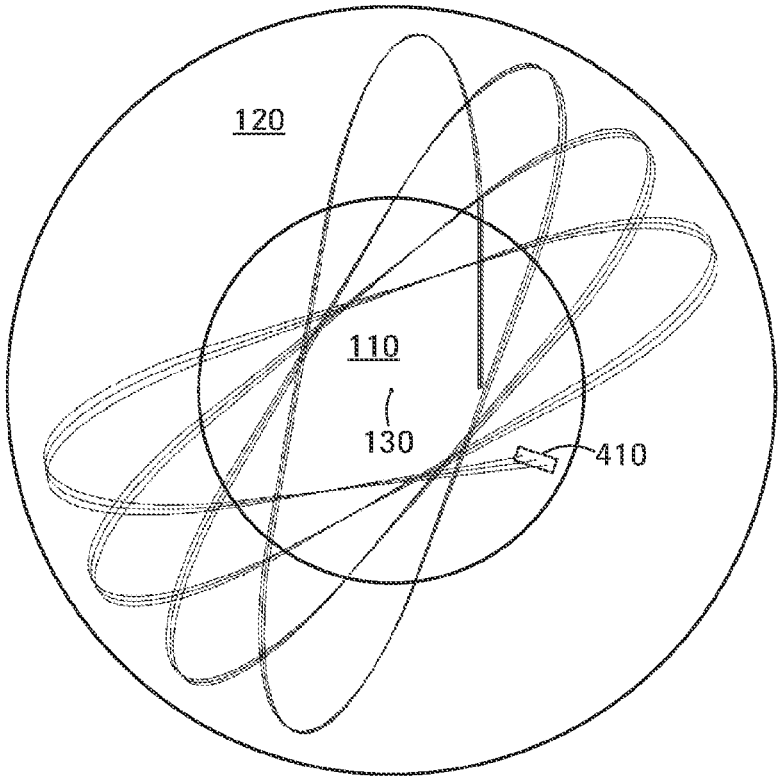

CENTRAL LENS FOR CYLINDRICAL GEOMETRY TIME-OF-FLIGHT MASS SPECTROMETER

CROSS REFERENCE TO RELATED APPLICATIONS

The present application is a continuation-in-part under 37 C.F.R. §1.53(b) of U.S. Pat. No. 7,919,748, entitled "Cylindrical Geometry Time-of-Flight Mass Spectrometer" naming Curt A. Flory and Trygve Ristroph as inventors, and filed on Mar. 31, 2009. The present application claims priority under 35 U.S.C. §120 to U.S. Pat. No. 7,919,748, and the entire disclosure of U.S. Pat. No. 7,919,748 is specifically incorporated herein by reference.

BACKGROUND

Mass spectrometry is a common analytical technique used in the physical and biological sciences. Time-of-flight mass spectrometry (TOF-MS) is one mass spectrometry technique used for analytical measurements. TOF-MS has such desirable characteristics as an almost limitless mass range, an ability to provide a complete mass spectrum from each ionization event, and relatively simple operational principles.

A TOF mass spectrometer is composed of an ion injector, a mass analyzer and an ion detector arranged in tandem. A packet of ions derived from a sample is input to the ion injector. The packet of ions is typically composed of ions of multiple, different ion species having respective mass-to-charge ratios. An electrical pulse applied to the ion injector imparts approximately the same initial kinetic energy to all the ions in the packet of ions in such a manner that the ions all move in the same direction of travel. The ions of each ion species travel at a respective velocity that depends on the mass-to-charge ratio of the ion species. The ions pass into the mass analyzer, which, in its simplest implementation, is an elongate evacuated chamber. In the mass analyzer, the differing velocities of the different ion species cause the ions of the respective ion species to separate in the direction of travel. At the distal end of the mass analyzer, the ions are incident on the ion detector, which measures the abundance of ions incident thereon within successive narrow time-of-flight windows to produce a time-of-flight spectrum. The time-of-flight spectrum represents the relationship between ion abundance and time of flight. Since the time of flight of the ions of a given ion species is proportional to the square root of the mass-to-charge ratio of the ion species, the time-of-flight spectrum can be converted directly to a mass spectrum that represents the relationship between ion abundance and mass-to-charge ratio. In this disclosure, for brevity, term mass-to-charge ratio will be abbreviated as mass.

The mass resolution in a mass spectrometer is defined as $T/2\Delta T$, where T is the measured time of flight at a given mass, and $\Delta T$ is the measured or calculated time-of-flight spread. For a TOF mass spectrometer, the square root dependence of the time of flight on the mass dictates that, for large masses, the peak separation decreases inversely with the square root of the ion mass. In recent years there has been a significant increase in applications of mass spectrometry to large biological molecules. Such applications have mass resolution demands that exceed the capabilities of conventional TOF-MS systems. To make TOF mass spectrometers, with their many other desirable characteristics, viable for use in such applications, their mass resolution must be increased.

The mass resolution of a TOF mass spectrometer is proportional to the length of the flight path between the ion injector and the detector. A typical TOF mass spectrometer has a linear flight path. Increasing the physical length of such linear flight path until the required resolution is reached would increase the physical dimensions of the instrument beyond those considered reasonable. One solution is to use a multiply-reflected folded flight path, in which the flight path between ion injector and ion detector has a zigzag trajectory in which the ions are reflected at multiple apexes in the flight path by respective gridless electrostatic mirrors. A zigzag flight path provides a significant increase in the flight path length within the overall dimensions of a conventional instrument. The ion mirrors perform spatial focusing to reduce ion losses and keep the beam confined regardless of the number of reflections. However, aligning the multiple electrostatic mirrors during fabrication can be difficult. Moreover, even though the zigzag arrangement decreases the maximum dimensions of the evacuated space in which the ions travel, it may undesirably increase the overall volume of the evacuated space.

Using only two electrostatic mirrors in a coaxial arrangement reduces the severity of the post-fabrication alignment problem but undesirably reduces the mass range that can be measured. Other zigzag configurations suffer from a lack of ion focusing in the plane of the zigzag ion path. This undesirably allows the ion beam to diverge after only a few reflections, which reduces the maximum practical length of the flight path. Using intermediate periodic ion lenses reduces beam spreading but adds complexity to the mass spectrometer.

Accordingly, what is needed is a mass analyzer for a time-of-flight mass spectrometer that provides a substantially increased ion flight path length without a commensurate increase in the volume of the evacuated space and that is easy to fabricate.

SUMMARY

In a representative embodiment, a mass analyzer comprises a pair of planar electrode structures. The electrode structures are disposed opposite to each other, parallel to each other, and axially offset from each other. The electrode structures are configured to generate, in response to an applied voltage, a cylindrically-symmetric, annular electric field comprising an annular radially focusing central lens region surrounding an axis of symmetry, and an annular mirror region surrounding the annular radially focusing central lens region.

In another representative embodiment a mass spectrometry method, comprises: establishing a cylindrically-symmetric, annular electric field comprising an annular radially focusing central lens region surrounding an axis of symmetry, an annular mirror region surrounding the annular radially focusing central lens region, and a field-free region between the annular radially focusing central lens region and the annular mirror region. The method comprises detecting a packet of ions within the field-free region after the ions have been at least twice reflected by the mirror region of the annular electric field.

In another representative embodiment, a mass analyzer comprises a pair of planar electrode structures. The electrode structures are disposed opposite to each other, and are configured to generate, in response to an applied voltage, a cylindrically-symmetric, annular electric field comprising a lens region and a mirror region surrounding the lens region.

BRIEF DESCRIPTION OF THE DRAWINGS

The example embodiments are best understood from the following detailed description when read with the accompanying drawing figures. Wherever applicable and practical, like reference numerals refer to like elements.

FIG. 4A is a graph showing the radial variation of electric potential in an example of a cylindrically-symmetrical electric field used in a simplified model of a mass analyzer in accordance with a representative embodiment.

FIG. 4B is a schematic drawing showing the beginning and the end of respective half orbits executed by three ions injected at different radial injection positions.

FIG. 4C is a schematic drawing showing the trajectories of the three ions shown in FIG. 4B over a time sufficient for each of the ions to execute slightly more than four full orbits.

DETAILED DESCRIPTION

Figure 1A:
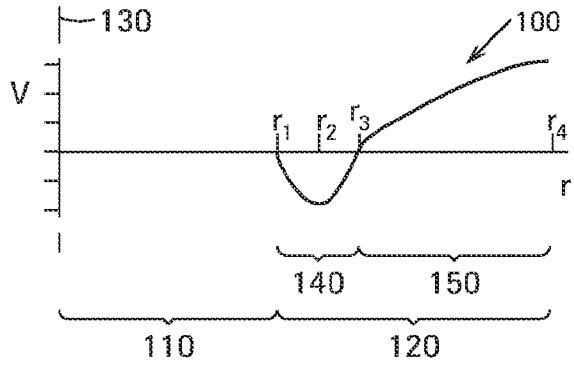
FIG. 1A is a graph showing the radial variation of electric potential in an example of the cylindrically-symmetrical electric field used in a mass analyzer in accordance with a representative embodiment.

In the following detailed description, for purposes of explanation and not limitation, example embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the example embodiments. Such methods and apparatuses are clearly within the scope of the present teachings.

A mass analyzer in accordance with an embodiment of the invention employs a cylindrically-symmetric, annular electric field surrounding a circular central region to cause ions to execute a number of elliptical, angularly-precessing orbits in a flight path that extends from an ion injector to an ion detector.

In certain embodiments, the electric field is composed of an annular, axially-focusing lens region surrounding the central region, and a mirror region surrounding the lens region. The electric field has a radially-increasing electric potential within the mirror region. In other words, within the mirror region, the electric potential increases with increasing distance from the axis of symmetry located at the center of the central region. The central region is sufficiently large to accommodate an ion injector and an ion detector. The ion injector is radially offset from the axis of symmetry and is operable to direct a packet of sample ions tangentially towards the electric field. The electric field causes the ions to execute a number of elliptical high aspect ratio orbits in which each half of each orbit has a respective apogee in the mirror region. Successive orbits precess around the axis of symmetry, so that the major axis of each orbit is angularly offset from the major axis of the previously-executed orbit and the major axis of the subsequently-executed orbit. As a result, on each successive orbit the ions return to a location in the central region progressively circumferentially offset from the ion injector. The ion detector is located to intersect the trajectory of the ions.

In certain embodiments, the electric field is composed of a cylindrically-symmetric, annular electric field comprising an annular radially focusing central lens region surrounding an axis of symmetry, and an annular mirror region surrounding the annular radially focusing central lens region ("central lens region"). A field-free region exists between the central lens region and the mirror region. An annular radially focusing central lens ("central lens") provides convergent lensing properties in the plane of the mass analyzer, causing the otherwise diverging ion trajectories to remain better collimated over the full flight path to the ion detector.

The orbits executed by the ions are described above as elliptical to simplify the description. In some embodiments, the cylindrically-symmetric, annular electric field has properties that cause the ions to execute orbits that quite closely resemble ellipses. In other embodiments, the electric field has properties that cause the ions to execute orbits that depart significantly from the elliptical, especially in the turn-round regions where the radial component of the velocity vector representing the ions' direction of travel along the orbit changes sign, i.e., from radially outwards to radially inwards.

Depending on the properties of the electric field, the position and orientation of the ion injector and the position of the ion detector, the number of orbits executed by the ions between the ion injector and the ion detector can range from a few to several tens. An example in which the ions execute 18 orbits will be described below. Since each orbit has a path length of the order of twice the outside diameter of the mirror region of the electric field, the path length needed to obtain a specified mass resolution can be accommodated within an evacuated space significantly smaller than that of a conventional TOF mass spectrometer having a linear or zig-zag flight path and the same mass resolution. Moreover, as will be described in detail below, the electric field is generated by a pair of fixed electrode structures capable of being positioned opposite one another during manufacture with sufficient precision that mechanical adjustment is not required. Consequently, a mass analyzer in accordance with an embodiment of the invention is simpler and faster to make than a mass analyzer having a zigzag flight path. Finally, the electric field provides ion focusing, so additional structures need not be provided for this.

Figure 1B:
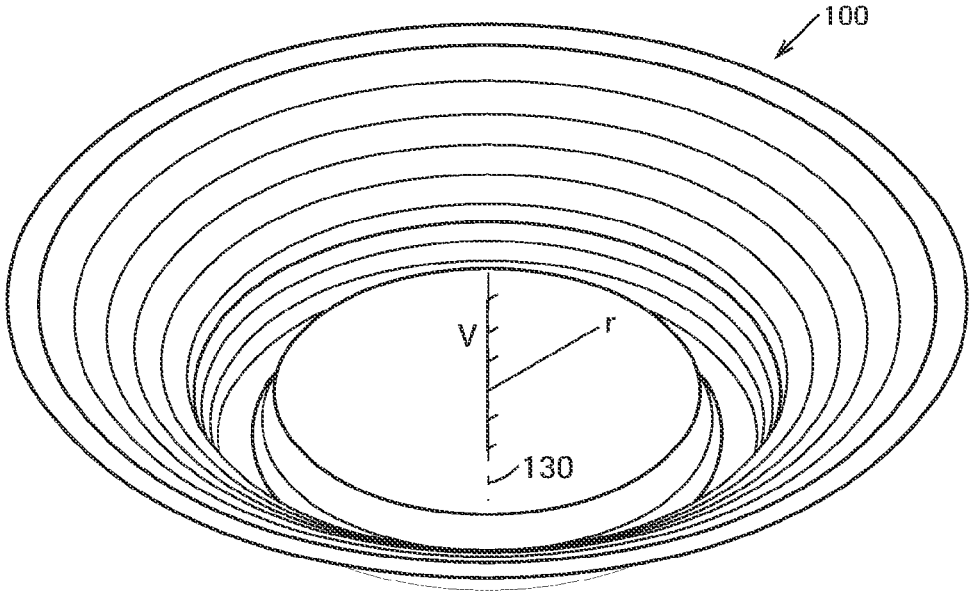
FIG. 1B is an isometric map showing the cylindrical symmetry of the spatial variation of electric potential in the example shown in FIG. 1A.

FIG. 1A is a graph showing the variation of electric potential V with radius r from the axis of symmetry in an example of the cylindrically-symmetrical electric field 100 used in a mass analyzer in accordance with an embodiment of the invention. The electric potential varies such that the direction of the electric field is predominantly radial. FIG. 1B is an isometric map showing the cylindrical symmetry of the spatial variation of electric potential in the example shown in FIG. 1A.

Referring first to FIG. 1A, electric field 100 is established in an annular field region 120 surrounding a cylindrical central region 110. Central region 110 and field region 120 are both centered on an axis of symmetry 130. In a typical embodiment, any electric field in central region 110 has a field strength that is negligible compared with electric field 100. Central region 110 has a perimeter at a radial distance $r_1$ from axis of symmetry 130. As the radial distance from axis of symmetry 130 increases past radial distance $r_1$, the electric potential of electric field 100 changes steeply to a maximum negative value at a radial distance $r_2$, and then steeply returns to zero at a radial distance $r_3$. The portion of electric field 100 between radial distance $r_1$ and radial distance $r_3$ constitutes an annular, axially-focusing lens region 140. In some embodiments, the portion of electric field 100 between radial distance $r_1$ and radial distance $r_3$ constitutes an Einzel lens, which has an axial focusing characteristic. As the radial distance from axis of symmetry 130 increases past radial distance $r_3$, the electric potential of electric field 100 increases progressively to a maximum positive value at a radial distance $r_4$, which corresponds to the outer limit of the electric field. The portion of electric field 100 between radial distance $r_3$ and radial distance $r_4$ constitutes mirror region 150. The profile of electric field 100 is the same along any radius extending from axis of symmetry 130. In electric field 100, the profile illustrated in FIG. 1A is rotated about axis of symmetry 130 to obtain the profile shown in the isometric map view shown in FIG. 1B.

In electric field 100, the rapidly-varying electric potential within lens region 140 subjects ions travelling towards mirror region 150 first to a radial force first directed away from axis of symmetry 130 and next to a radial force first directed towards axis 130. The rapidly-varying electric potential within lens region 140 additionally subjects the ions travelling towards mirror region 150 to an axial force that alternates in direction. The radial and axial forces collectively provide ion focusing in the axial direction, i.e., the direction of axis of symmetry 130. Next, the radially-increasing electric potential within mirror region 150 subjects the ions to a predominantly radial force directed towards axis of symmetry 130. This radial force reverses the radial component of the velocity vector of the ions, and causes the ions to move back towards central region 110.

Figure 2A:
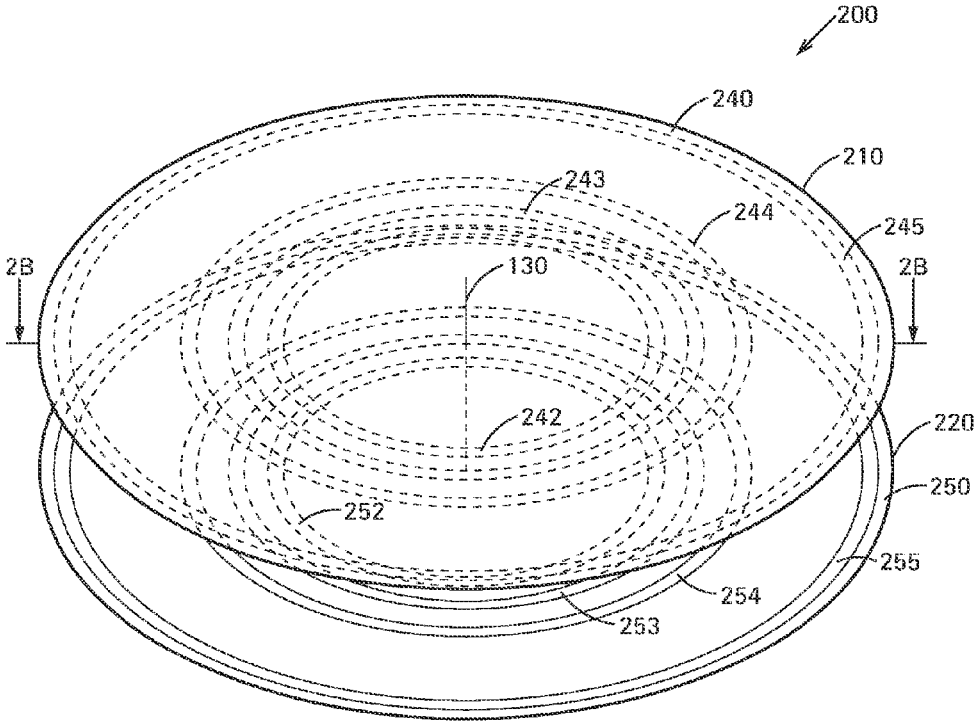
FIG. 2A is an isometric schematic drawing showing a simplified example of a mass analyzer in accordance with a representative embodiment.

FIG. 2A is an isometric schematic drawing showing a simplified example of a mass analyzer 200 in accordance with an embodiment of the invention. Mass analyzer 200 is composed of an electrode structure 210 and an electrode structure 220. In the example shown, electrode structure 210 is composed of a planar insulating substrate 240 having concentric annular electrodes on one of its major surfaces. The example of electrode structure 210 shown has four electrodes 242, 243, 244 and 245 having radii approximately equal to radii $r_1$, $r_2$, $r_3$ and $r_4$, respectively, shown in FIG. 1A. Electrode structure 220 is composed of a planar insulating substrate 250 having concentric annular electrodes on one of its major surfaces.

The example of electrode structure 220 shown has four electrodes 252, 253, 254 and 255 nominally identical to electrodes 242, 243, 244 and 245, respectively.

Electrode structure 220 is disposed parallel to electrode structure 210 with electrodes 252-255, facing electrodes 242-245, parallel to electrodes 242-245 and offset from electrodes 242-245 in the direction of axis of symmetry 130. Moreover, electrodes 242-245 and electrodes 252-255 are centered on axis of symmetry 130. Thus, electrode structure 220 can be regarded as being disposed opposite, parallel to, concentric with, and axially offset from electrode structure 210.

Figure 2B:
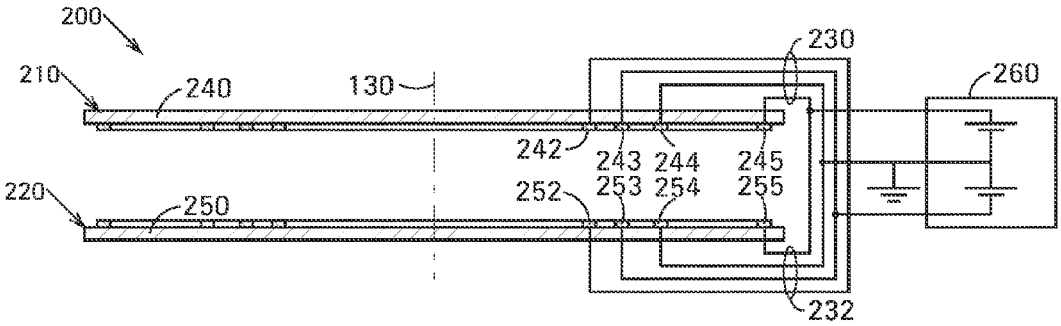
FIG. 2B is a cross-sectional view of the mass analyzer shown in FIG. 2A along the section line 2B-2B showing electrical connections connected to apply patterns of voltages to the electrodes of the electrode structures.

FIG. 2B is a cross-sectional view of mass analyzer 200 showing an electrical connection 230 connected to apply a first pattern of voltages to the electrodes 242-245 of electrode structure 210, and an electrical connection 232 connected to apply a second pattern of voltages to the electrodes 252-255 of electrode structure 220. The first pattern of voltages applied to electrodes 242-245 and the second pattern of voltages applied to electrodes 252-255 are nominally identical. The first pattern of voltages applied to electrodes 242-245 and the second pattern of voltages applied to electrodes 252-255 generates electric field 100 (FIG. 1B) in the space axially bounded by electrode structures 210, 220. The radii of electrodes 242-245 and 252-255 and the pattern of voltages applied to the electrodes are configured to produce electric field 100 with the profile described above.

Also shown schematically in FIG. 2B is a power supply 260 that supplies the pattern of voltages to electrical connections 230, 232. In some embodiments, power supply 260 constitutes part of mass analyzer 200 or a mass spectrometer of which electrode structures 210, 220 constitute part. In other embodiments, power supply 260 is external to mass analyzer 200 or a mass spectrometer of which electrode structures 210, 220 constitute part.

In FIG. 2B, conventional battery symbols are used to indicate the relative polarities of the voltages provided by power supply 260. In the example shown, electrical connection 230 connects electrodes 242, 244 and electrical connection 232 connects electrodes 252 and 254 to ground or another fixed potential. Electrical connections 230, 232 connect electrodes 243, 253, respectively, to a negative DC voltage and additionally connect electrodes 245, 255, respectively, to a positive DC voltage. In the example shown, electrodes 242, 244, 252, 254 are electrically connected to the same voltage, i.e., ground. In other embodiments, electrical connections 230, 232 connect electrodes 244, 254 to a DC voltage different from that to which electrodes 242, 252 are connected. In some embodiments, none of the electrodes is grounded, but the electrodes have relative potentials that follow the pattern just described.

Electrode structure 210, electrode structure 220, electrical connections 230, electrical connections 232 and power supply 260 collectively perform the function of establishing cylindrically-symmetric, annular electric field 100 around circular central region 110. Electric field 100 comprises annular axially-focusing lens region 140 surrounding central region 100, and annular minor region 150 surrounding lens region 140.

The example of mass analyzer 200 shown in FIGS. 2A and 2B is simplified in the sense that the number of electrodes shown is reduced to the minimum needed to generate electric field 100 with the characteristics shown in FIG. 1A. This enables the structure of mass analyzer 200 to be shown more clearly. Typically, electrode structure 210 is additionally composed of one or more additional annular electrodes located between, and concentric with, electrodes 244 and 245. Power supply 260 supplies to such additional electrodes respective voltages intermediate to those it supplies to electrodes 244 and 245. Electrode structure 210 may additionally be composed of one or more additional annular electrodes located between, and concentric with, electrodes 243 and 244 to which power supply 260 supplies respective voltages intermediate to those supplied to electrodes 243 and 244. The respective voltages applied to the additional electrodes perform the function of establishing the annular electric field comprising annular regions within each of which the electrical potential changes with a respective slope. Moreover, a circular electrode having the same diameter as the outside diameter of electrode 242 may be substituted for electrode 242. An arrangement similar to that just described is described below with reference to FIGS. 14A and 14B. Typical embodiments of electrode structure 220 are similar in structure to that of electrode structure 210 just described.

Figure 3A:
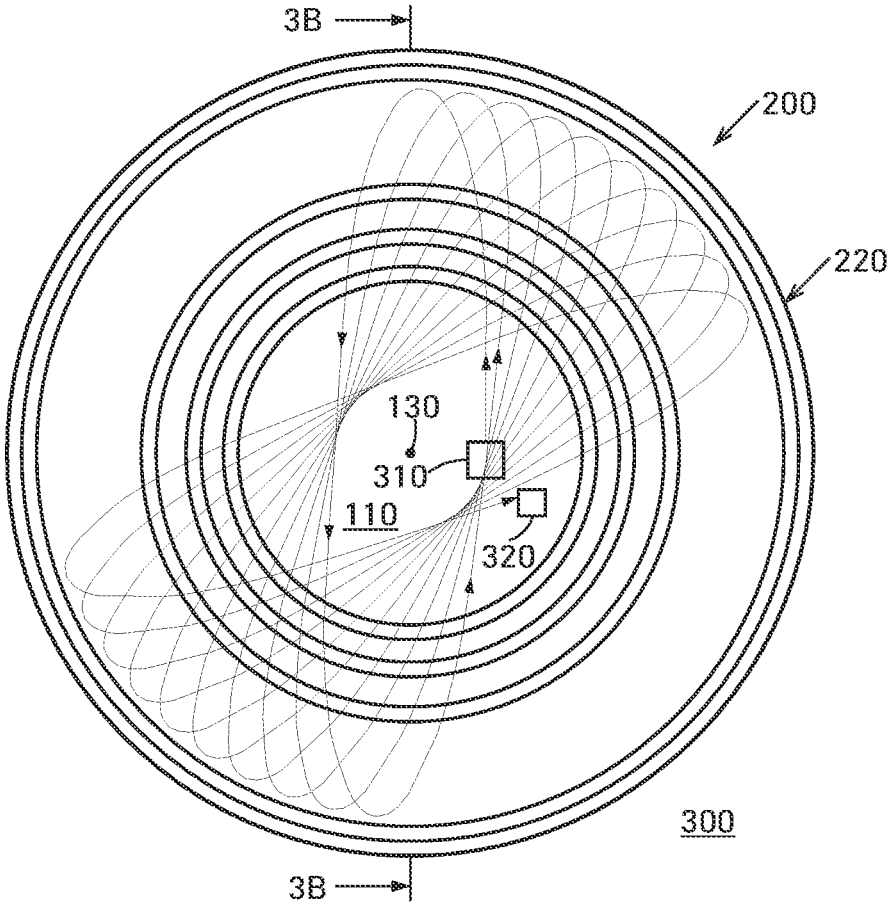
FIG. 3A is a plan view a showing an example of a mass spectrometer in accordance with a representative embodiment.
Figure 3B:
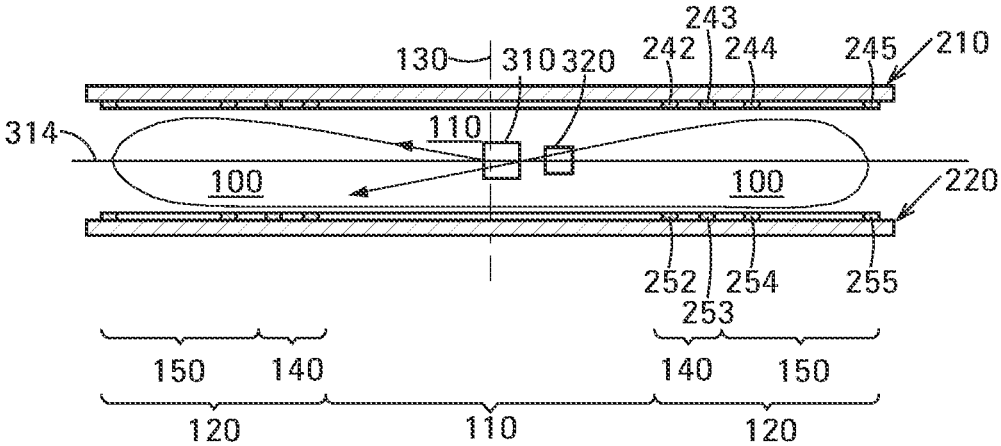
FIG. 3B is a cross-sectional view of the mass spectrometer shown in FIG. 3A along the section line 3B-3B.

FIG. 3A is a plan view and FIG. 3B is a cross-sectional view showing an example of a mass spectrometer 300 in accordance with an embodiment of the invention. Mass spectrometer 300 incorporates an example of mass analyzer 200 described above with reference to FIGS. 2A and 2B. In FIG. 3A, electrode structure 210 shown in FIG. 3B is made transparent to enable electrode structure 220 and the interior of mass analyzer 200 to be shown. Referring to FIGS. 3A and 3B, in addition to mass analyzer 200, mass spectrometer 300 is composed of an ion injector 310 and an ion detector 320. Ion injector 310 and ion detector 320 are located within the cylindrical central region 110 of mass analyzer 200. Central region 110 is bounded by electrode structure 210 and electrode structure 220 in the axial direction and electrodes 242 and 252 in the radial direction. In an example, ion injector 310 is located between electrode structure 210 and electrode structure 220 in the axial direction, and is radially offset from axis of symmetry 130. Ion injector 310 is positioned and oriented such that the ions are directed towards mirror region 150 in a tangential direction that lies in median plane 314 axially mid-way between electrode structure 210 and electrode structure 220. The tangential direction is orthogonal to a radius extending from axis 130 to the ion injector.

Ion detector 320 is located in median plane 314, and is radially offset from axis of symmetry 130 at a position that intercepts the path of the ions after the ions have executed a predetermined number of orbits.

Ion injector 310 directs packets of ions in the tangential direction towards mirror region 150. The ions execute a series of high aspect ratio elliptical orbits that precess gradually about axis of symmetry 130, as shown in FIG. 3A. Moreover, in the axial direction shown in FIG. 3B, each orbit returns to median plane 314 notwithstanding any axial component in the injection velocity vector of the ions as they are output by ion injector 310. The trajectories of the orbits executed by the ions are independent of the mass of the respective ions, but the velocity at which the ions execute the trajectories and, hence, the time of flight from ion injector 310 to ion detector 320, depends on the mass of the ions.

In the example shown, ion detector 320 is located to intercept the trajectory of the ions after the ions have executed 10 complete orbits. The number of orbits constituting the trajectory is determined by the relative positions and orientations of ion injector 310 and ion detector 320 and the properties of electric field 100. Locating ion injector 310 closer to axis of symmetry 130 reduces the precession rate, which increases the number of orbits executed by the ions before the ions are intercepted by ion detector 320, and, hence, the length of the flight path. The large number of orbits executed by the ions means that mass spectrometer 300 has a flight path many times longer, and, hence, a mass resolution many times greater, than a conventional mass spectrometer having the same maximum linear dimension.

As will be described below, the radii of the electrodes constituting electrode structures 210, 220 and the voltage pattern applied to the electrodes can be optimized to minimize time-of-flight aberrations, to produce ion spatial focusing that minimizes ion propagation loss, and to provide robust acceptance properties with respect to ion injector 310. Ions injected into mass analyzer 200 within the acceptance properties thereof will be successfully directed to ion detector 320. Configurations described below have mass resolutions on the order of several hundred thousand with reasonable acceptance volumes. The acceptance volume of mass analyzer 200 is a phase space that describes respective ranges of the ion injection properties. Mass analyzer 200 will successfully direct an ion whose ion injection properties are within the acceptance volume to ion detector 320 while maintaining the specified mass resolution. A large acceptance volume increases the fraction of the ions injected by ion injector 310 that mass analyzer 200 successfully directs to ion detector 320 and, hence, the analyte sensitivity of mass spectrometer 300 incorporating mass analyzer 200.

In some examples of mass spectrometer 300, an ion source, such as a matrix assisted laser desorption (MALDI) ion source or a secondary ionization mass spectrometry ion source (SIMS) is used as ion injector 310. In other examples, ion injector 310 is part of an ion source (not shown) that additionally comprises an ionizer (not shown) located external to mass analyzer 200 and a conduit (not shown) that extends axially from the ionizer to ion injector 310 through one of electrode structures 210, 220. The ionizer ionizes sample molecules using an ionization mechanism such as electrospray (ESI), atmospheric pressure chemical ionization (APCI), electron impact (EI), chemical ionization (CI), photo ionization (PI) or another suitable ionization mechanism. The resulting ions pass though the conduit into ion injector 310, where they accumulate. Ion injector 310 can be a conventional pulsed Wiley-McLaren orthogonal accelerator in which an electrical pulse applied to electrodes that constitute part of the ion injector momentarily subjects the accumulated ions to an electric field. The electric field directs the accumulated ions in the above-mentioned tangential direction towards electric field 100. In another example, a pulsed ion source (not shown) is used as the above-described external ionizer and ion injector 310 comprises an electrostatic or a magnetic deflector (not shown). The pulsed ion source directs packets of ions derived from the sample into the conduit. The deflector changes the direction of travel of each packet of ions received from the conduit from the axial direction to the above-mentioned tangential direction. Other types of ion injector are known and may be used as ion injector 310.

Ion detector 320 can be any ion detector used in conventional TOF mass spectrometers. In an example, ion detector 320 is a microchannel plate detector (MCP) followed by a time-to-digital converter (TDC) or a fast analog-to-digital converter (ADC). The combination of detector and converter generates an electrical signal that represents a time-of-flight spectrum or a mass spectrum of the packet of ions injected into mass analyzer 200 by ion injector 310. Other types of ion detector are known and may be used.

If the ions constituting the ion packets injected into mass analyzer 200 by ion injector 310 had injection energy spreads, injection direction spreads, and injection position spreads of zero, mass spectrometer 300 described above with reference to FIGS. 3A and 3B would have the maximum mass resolution of which it is capable for a given ion pulse length and total ion flight time through its use of annular electric field 100 to guide the ions. However, all practical ion injectors have an extended initial phase space. Consequently, the sensitivity of mass analyzer 300 to spreads in the injection energy, injection direction, and injection position ultimately determines the ability of the mass spectrometer to generate high-resolution mass spectra while maintaining analyte sensitivity. To realize the desired mass resolution gains from the extended flight path of mass analyzer 200 in accordance with an embodiment of the invention, a high-order time-of-flight focusing of ions at the ion detector, and spatial ion focusing that minimizes ion losses over the extended flight path are needed. The specific ion injection parameters that can affect the ions' flight times are injection position spread, which has axial and radial components, injection direction spread, which also has axial and radial components, and injection energy spread. Injection direction will be represented by an injection angle, which is the angle between the direction at which the ions exit ion injector 310 and the tangential direction, i.e., the normal to the radius that extends from axis of symmetry 130 to ion injector 310.

Optimization of a mass spectrometer in accordance with an embodiment of the invention to minimize the time-of-flight aberrations resulting from injection position spread (radial and axial), injection angle spread (radial and axial) and injection energy spread will now be described. Specifically, optimization of the relative radii of central region 110 and field region 120, the number and radii of the electrodes constituting each electrode structure 210, 220, the voltage pattern applied to the electrodes, the position of ion injector 310, and the position and angular orientation of ion detector 320 to obtain high-performance time-of-flight and spatial focusing will be described.

As described above, a mass analyzer in accordance with an embodiment of the invention uses electric field 100 to guide and to focus the ions as the ions travel from ion injector 310 to ion detector 320. As a result, similar to conventional designs employing multiple independent mirrors and lenses, a complete analysis of the aberration compensation and guiding dynamics cannot be rigorously separated into axial and radial components. However, to describe the dominant correlations between the degrees of freedom of the hardware and the various aberration compensations, first an approximate treatment of the ion dynamics in the nominal plane of the ion trajectory is performed, and then an approximate treatment of the dynamics in the axial direction, orthogonal to the plane of the ion trajectory, are set forth below. Next, a full three-dimensional treatment is set forth below. Finally, exemplary dimensions and voltages are described, together with specifications of the expected performance for a realistic time-of-flight mass spectrometer in accordance with an embodiment of the invention.

Approximate In-Plane Ion Dynamics

A simplified model of a mass analyzer in accordance with an embodiment of the invention will now be described to aid in developing a description of the dynamics of the ions in the two-dimensional plane of the ion trajectories, and to show the dominant time-of-flight aberrations and the corrections of such aberrations. The simplified model ignores variations of electric potential in the axial direction as well as any ion motion in that direction. Initially, for the purpose of illustration, a simplified model will be described. FIG. 4A is a graph showing the variation of electric potential V with radius r from the axis of symmetry in an example of the cylindrically-symmetrical electric field 101 used in the simplified model. In the simplified model, the mirror region 150 of electric field 101 occupies all of field region 120, and the electric potential Vin mirror region 150 increases linearly with increasing radius, i.e. the electric potential is zero at values of radius r less than radius $r_1$ corresponding to the radius of central region 110 and is proportional to radius r at values of the radius greater than radius $r_1$. Later, this constraint will be relaxed as the aberrations are analyzed and the analysis develops. For the simplified model, three parameters are required to specify the trajectory of a single ion: the ion energy; the slope of the electric potential in mirror region 150 (or equivalently, a turn-around radius $r_t$, i.e., the radius at which interaction with the electric field reverses the radial component of the velocity of an ion of a specified energy); and the radius $r_0$ at which the ion is injected in the tangential direction into central region 110. The tangential direction is orthogonal to the radius extending from axis of symmetry 130 to the ion injection position. Specifying these parameters is sufficient to uniquely compute the ion trajectory in this simplified two-dimensional mass analyzer. By computing ion trajectories for the ions constituting an ion packet having a non-zero radial injection position spread and a non-zero injection energy spread, the dominant time-of-flight aberrations can be analyzed and corrected. For this simplified analysis, an injection angle spread of zero will be assumed.

FIGS. 4B and 4C are plan views showing calculated ion trajectories for an ion packet 410 composed of three ions 412, 413, 414 of identical masses injected tangentially with the same injection energy $E_0$ at respective radial injection positions at radii $r_0-\Delta r_0$, $r_0$ and $r_0+\Delta r_0$. FIG. 4B schematically shows each ion 412-414 following a respective trajectory that returns to a minimum radius (apsis) corresponding to the injection radius of the respective ion. This is due to the conservation of angular momentum in a rotationally-symmetric conservative system. However, each ion 412-414 follows a respective trajectory that generates a different half-orbit angle $\xi_{1/2}$. The half-orbit angle of each ion 412-414 is the angle subtended by the half orbit of the ion. In other words, for each ion 412-414, the respective half-orbit angle $\xi_{1/2}$ is the angle between a radius through the respective injection position and a radius through the respective apsis. The differing half-orbit angles cause the trajectory of each ion 412-414 to have a respective precession rate about axis of symmetry 130 different from that of the trajectories of the other ions. The precession angle between successive half orbits of a given ion is the supplement of the half-orbit angle of the ion, i.e., $(\pi-\xi_{1/2})$. This causes ion packet 410 to diverge in the plane of the ion trajectories in a direction orthogonal to the direction of the trajectories. The divergence of ion packet 410 progressively increases in successive orbits. Additionally, the trajectory of each ion 412-414 follows a unique path, and therefore has a different flight time to its respective apsis. This causes a time-of-flight aberration, i.e., the flight times of ions 412-414 constituting ion packet 410 differ despite the ions having identical masses.

FIG. 4C schematically shows the trajectories of ions 412-414 (FIG. 4B) constituting ion packet 410 over a time sufficient for each of the ions to execute slightly more than four full orbits. The figure shows the divergence of ions 412-414 constituting ion packet 410 due to the unequal precession rates, and the time-of-flight aberration demonstrated by the ion front of ion packet 410 no longer being orthogonal to the trajectory of ion 413.

Figure 5:
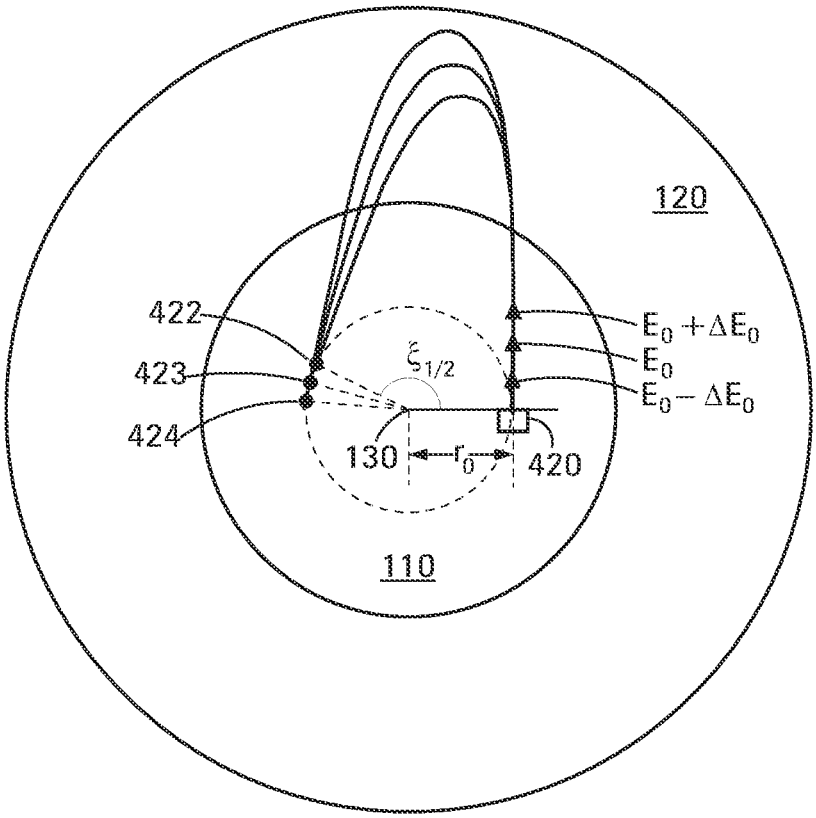
FIG. 5 is a plan view showing respective calculated ion trajectories for three ions of identical mass injected at the same radial injection position with different injection energies.

FIG. 5 is a plan view showing calculated ion trajectories for an ion packet 420 composed of three ions 422, 423, 424 of identical mass injected tangentially at the same radial injection position at radius $r_0$ with respective injection energies $E_0-\Delta E_0$, $E_0$ and $E_0+\Delta E_0$. From the plots of the respective half-orbits of ions 422, 423, 424 to a common first apsis, it can be seen that each trajectory generates a different half-orbit angle $\xi_{1/2}$ and has a different flight time to its apsis. Consequently, the differing injection energies of ions 422, 423, 424 constituting ion packet 420 will subject ion packet 420 to the same sort of spatial divergence and time-of-flight aberrations as ion packet 410 described above with reference to FIG. 4C.

A mass analyzer in accordance with an embodiment of the invention uses a compensation scheme to eliminate, to a first order, the above-described time-of-flight aberrations due to the radial injection position spread and the injection energy spread of the ions within the ion packet. Operation of the compensation scheme will be described with reference to the ion trajectories at the apsides for ions having different radial injection positions and different injection energies.

Figure 6A:
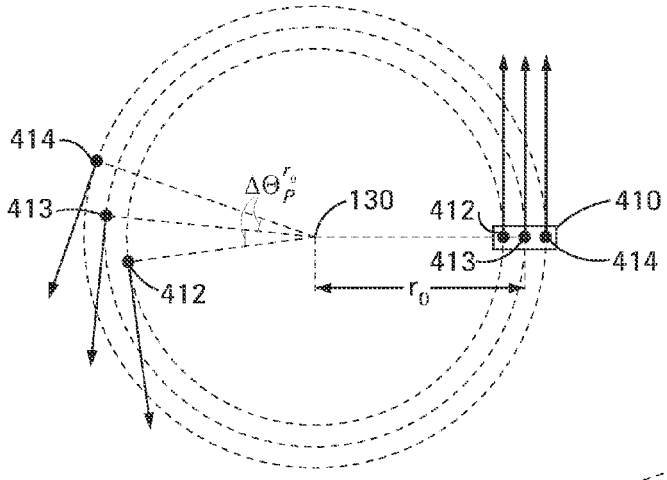
FIGS. 6A-6C are plan views each showing further details of the trajectories of the three ions injected at the different radial injection positions shown in FIG. 4B.
Figure 6B:
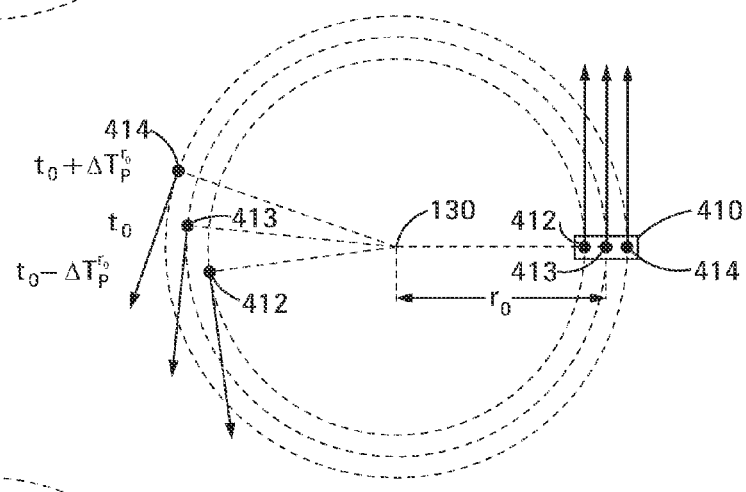
Figure 6C:
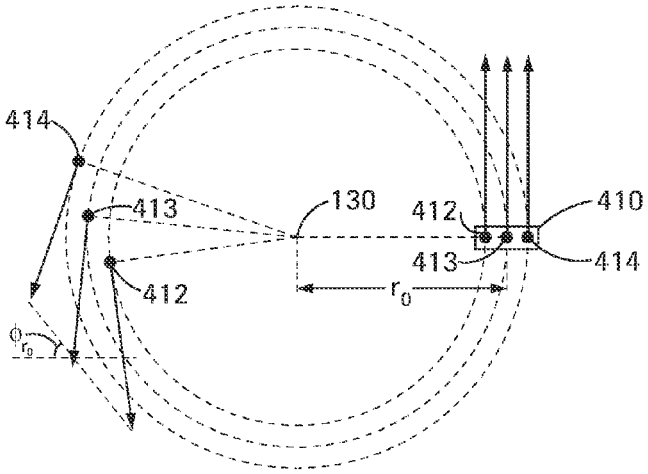

FIGS. 6A-6C are plan views each showing ions 412, 413, 414 constituting ion packet 410 as the ions are injected at respective radial injection positions as described above with reference to FIG. 4B. FIGS. 6A-6C additionally show ions 412-414 at their respective apsidal points after each of the ions has executed one half orbit. FIGS. 6A and 6B respectively show the precession angle lag/advance, i.e., an advance or lag in the precession angle equal to the supplement of half-orbit angle $\xi_{1/2}$ (i.e., $\pi-\xi_{1/2}$) and the flight-time lag/advance caused by ions 412, 414 being injected at radial injection positions $r_0-\Delta r_0$ and $r_0+\Delta r_0$ different from the radial injection position $r_0$ of ion 413. The precession angles shown in FIG. 6A of ions 412, 414 differ from that of ion 413 by $\pm\Delta\Theta_p^{r_o}$. The flight times shown in FIG. 6B of ions 412, 414 differ from that of ion 413 by $\pm\Delta T_p^{r_o}$. FIG. 6C shows how, for a small spread $\pm\Delta r_0$ in radial injection position about radial injection position $r_0$, the combined effect of the precession angle and flight-time aberrations tilts the ion front of ion packet 410 at an angle $\phi_{r_o}$ to the normal to the ion trajectory, in paraxial approximation. Orienting the ion-receiving surface of ion detector 320 parallel to the tilted ion front eliminates to first order the time-of-flight aberrations due to the radial position spread of the ions injected by ion injector 310.

Figure 7A:
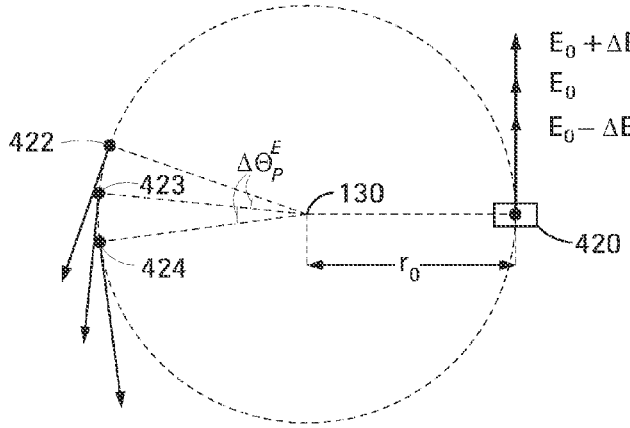
FIGS. 7A-7C are plan views each showing further details of the trajectories of the three ions injected with the different injection energies shown in FIG. 5.
Figure 7B:
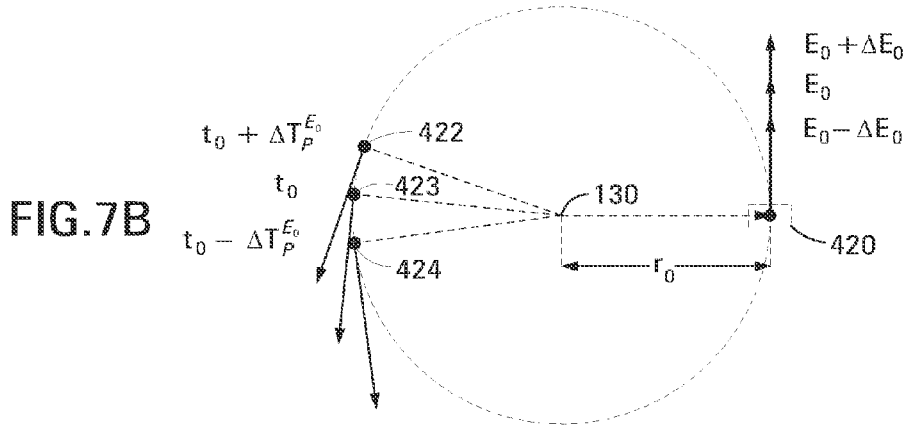
Figure 7C:
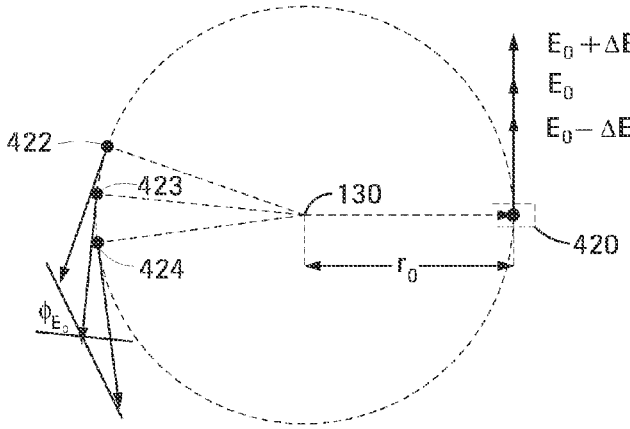

Similarly, FIGS. 7A-7C are plan views showing ions 422, 423, 424 constituting ion packet 420 as the ions are injected with respective injection energies as described above with reference to FIG. 5 and at their respective apsides following one half orbit. FIGS. 7A and 7B respectively show the precession angle lag/advance and the flight-time lag/advance caused by ions 422, 424 having respective injection energies $E_0-\Delta E_0$ and $E_0+\Delta E_0$ different from the injection energy $E_0$ of ion 423. The precession angles shown in FIG. 7A of ions 422, 424 differ by $\pm\Delta\Theta_p^{E_o}$ from that of ion 423, and the flight times shown in FIG. 7B of ions 422, 424 differ by $\pm\Delta T_p^{E_o}$ from that of ion 423. FIG. 7C shows how, for the small spread $\pm\Delta E_0$ in injection energy about injection energy $E_0$, the combined effect of the precession angle and flight-time aberrations tilts the ion front of ion packet 420 at an angle $\phi_{E_o}$ with respect to the normal to the ion trajectory. Orienting the ion-receiving surface of ion detector 320 parallel to the tilted ion front eliminates to first order the time-of-flight aberrations due to the injection energy spread of the ions injected by ion injector 310.

In general, there would be no reason to expect that the orientation of the ion-receiving surface of ion detector 320 needed to eliminate the effect of the injection energy spread of the ions would be the same as that needed to eliminate the radial injection position spread of the ions. However, the respective optimum orientation angles of the ion detector for compensating radial injection position spread and for compensating injection energy spread vary independently as the geometry of the mass analyzer is varied. As used in this disclosure, the term geometry refers to such parameters as the radii of the electrodes and the respective voltages applied thereto that determine the properties of electric field 100, and radial injection position $r_0$. Using the degrees of freedom afforded by the mass analyzer geometry, sets of mass analyzer parameters can be found for which the orientation of the ion detector needed to eliminate the time-of-flight aberrations caused by the injection energy spread $\pm\Delta E_0$ of the ions is precisely the same as that required to eliminate the time-of-flight aberrations caused by the radial injection position spread $\pm\Delta r_0$ of the ions.

Figure 8:
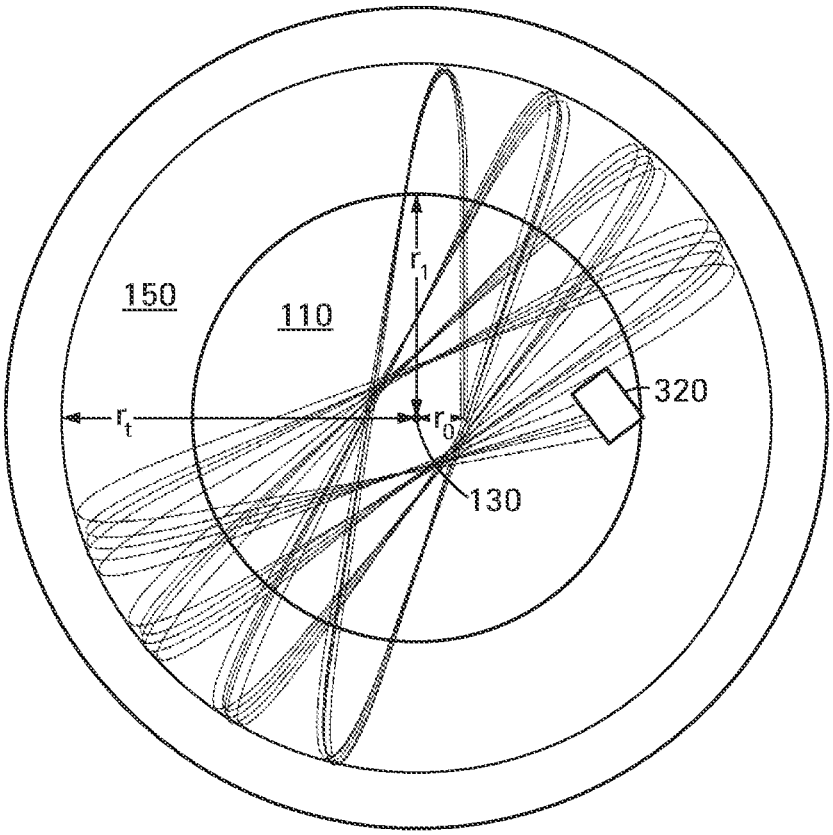
FIG. 8 is a plan view showing of the trajectories of five identical ions having different combinations of injection energy and radial injection position in the electric field represented by the graph shown in FIG. 4A.

FIG. 8 is a plan view showing of the trajectories of five identical ions having the following combinations of injection energy and radial injection position: $(E_0, r_0)$, $(E_0, (r_0+\Delta r_0))$, $(E_0, (r_0-\Delta r_0))$, $((E_0+\Delta E_0), r_0)$ and $((E_0-\Delta E_0), r_0)$ for an example of mirror region 150 in which the electric field strength is chosen such that the ion turn-around radius $r_t$ is 1.54 times the radius $r_1$ of central region 110, injection radius $r_0$ is 0.207 times the radius $r_1$ of central region 110, and $\Delta E_0/E_0=\Delta r_0/r_0=0.03$. Ion turn-around radius $r_t$ is the radial distance between axis of symmetry 130 and the average apogee radius of the orbits of the ions. In this example, the trajectories of the five ions form an isochronous ion front that allows the aberrations resulting from the ions having both a radial injection position spread and an injection energy spread to be eliminated, to first order, simply by appropriately orienting the ion-receiving surface of ion detector 320 to match the tilt of the ion front.

The specific mass analyzer geometries that eliminate the aberrations resulting from the ions having both a radial injection position spread and an injection energy spread are limited to configurations in which the electric field in mirror region 150 has a linear potential gradient such that ion turn-around radius $r_t$ is between about 1.54 times and about 1.60 times the radius $r_1$ of central region 110. These parameters cause successive ion orbits to have a relatively high precession rate such that only six to eight orbits can be completed before the ion trajectory begins to overlap itself. This limitation on the number of ion orbits imposes a corresponding limitation to the achievable mass resolution.

The precession rate can be significantly reduced by reducing the potential gradient in mirror region 150, but a potential gradient that provides an acceptable precession rate causes ion turn-around radius $r_t$ to exceed the maximum of the above-described aberration compensation window. This problem can be overcome by introducing an additional degree of freedom into the configuration of the electric field in mirror region 150. Specifically, the electric field is configured so that the radial variation of electric potential in mirror region 150 has two or more different slopes. With the radial variation of electric potential having two or more different slopes, mass analyzer geometries can be found that provide both an acceptably-low precession rate and the above-described aberration correction. Adding a voltage degree of freedom and eliminating a geometric degree of freedom yields full aberration correction to first order with a greatly increased flight path length and, hence, mass resolution.

Figure 9:
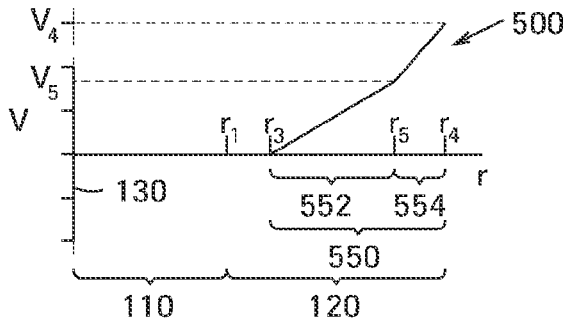
FIG. 9 is a graph showing the radial variation of electric potential in an example of the cylindrically-symmetrical electric field used in a mass analyzer in accordance with another representative embodiment.

FIG. 9 is a graph showing the variation of electric potential V with radius r from the axis of symmetry 130 in the mirror region 550 of an example of a cylindrically-symmetric electric field 500 established in the annular field region 120 of a mass analyzer in accordance with another embodiment of the invention. The lens region of electric field 500 is omitted to simplify the drawing. In the example shown, the radial variation of electric potential in mirror region 550 has two different slopes, with the electric potential increasing from zero to an electric potential $V_5$ in an annular first radial region 552 that extends between radii $r_3$ and $r_5$ and then increasing from electric potential $V_5$ to electric potential $V_4$ in an annular second radial region 554 between radii $r_5$ and $r_4$. The slope of the radial variation of electric potential in first radial region 552 is less than that in second radial region 554. In other embodiments, the radial variation of electric potential within mirror region 550 has more than two slopes. In some embodiments, one or more of the slopes of the radial variation of electric potential within mirror region 550 is negative.

Figure 10:
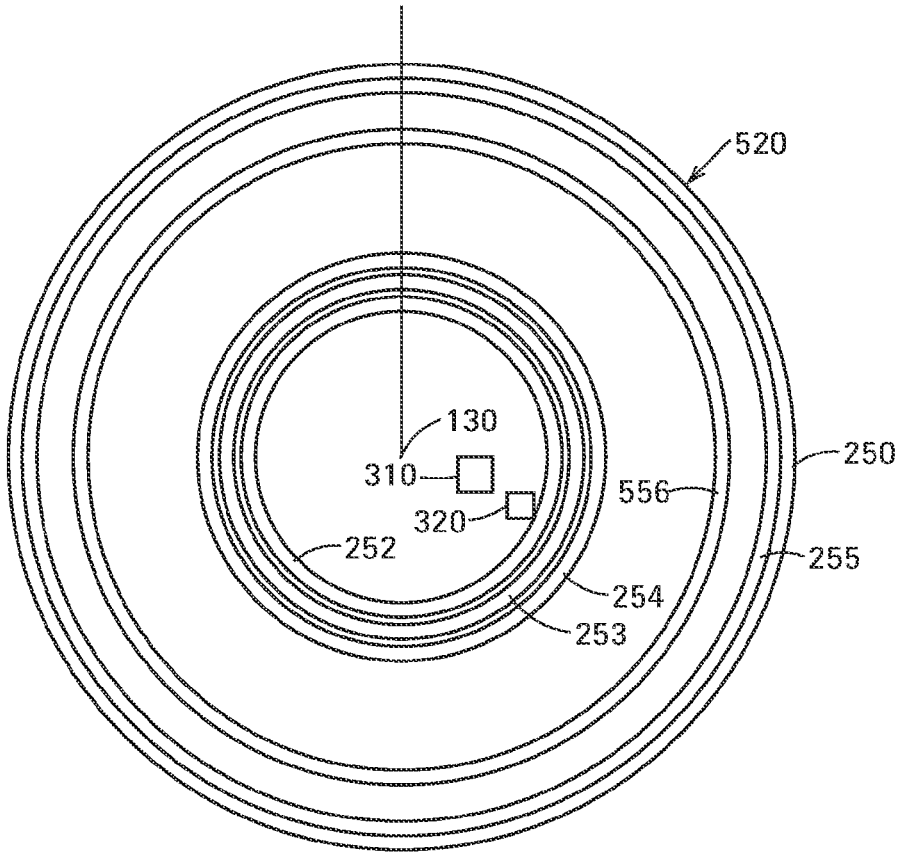
FIG. 10 is a plan view showing an example of a simplified embodiment of an electrode structure that, when disposed opposite, parallel to, and axially offset from a similar electrode structure and a suitable pattern of voltages is applied to both electrode structures, will generate the electric field represented by the graph shown in FIG. 9.

FIG. 10 is a plan view showing an example of a simplified embodiment of an electrode structure 520 that, when disposed opposite, parallel to, and axially offset from a similar electrode structure and a suitable pattern of voltages is applied to both electrode structures, will generate electric field 500 shown in FIG. 9. Elements of electrode structure 520 corresponding to elements of electrode structure 220 described above with reference to FIGS. 2A and 2B are indicated using the same reference numerals and will not be described again here. Electrode structure 520 is additionally composed of an annular electrode 556 interposed between electrode 254 and electrode 255 and concentric with electrodes 252-255. Electrode 556 has a radius approximately equal to radius $r_5$ (FIG. 9). In the example shown, electrode 556 is located on the major surface of insulating substrate 250. Referring additionally to FIG. 2B, electrical connection 232 is composed of an additional electrical conductor that supplies to electrode 556 voltage $V_5$ (FIG. 9) intermediate between the voltages applied to electrodes 254 and 255. Power supply 260 is structured to supply the additional voltage to electrode 556.

Electrode structure 520 is simplified in the sense that the number of electrodes shown is reduced to the minimum needed to generate electric field 500 with the characteristics shown in FIG. 9. This enables the structure of electrode structure 520 to be shown more clearly. Typically, electrode structure 520 is additionally composed of one or more additional annular electrodes interposed between, and concentric with, electrodes 254 and 556, and one or more additional electrodes interposed between, and concentric with, electrodes 556 and 255. Respective additional voltages are applied to such additional electrodes. The additional voltages applied to the electrodes interposed between electrodes 254 and 556 are intermediate to those applied to electrodes 254 and 556, and those applied to the additional electrodes interposed between electrodes 556 and 255 are intermediate to those applied to electrodes 556 and 255. Electrode structure 520 may additionally be composed of one or more additional annular electrodes located between, and concentric with, electrodes 253 and 254 to which are applied respective voltages intermediate to those applied to electrodes 253 and 254. Moreover, a circular electrode having the same diameter as the outside diameter of electrode 252 may be substituted for electrode 252. An arrangement similar to that just described is described below with reference to FIGS. 14A and 14B. Typical embodiments of the electrode structure (not shown) disposed opposite electrode structure 520 are similar in structure to that of electrode structure 520 just described.

Figure 11:
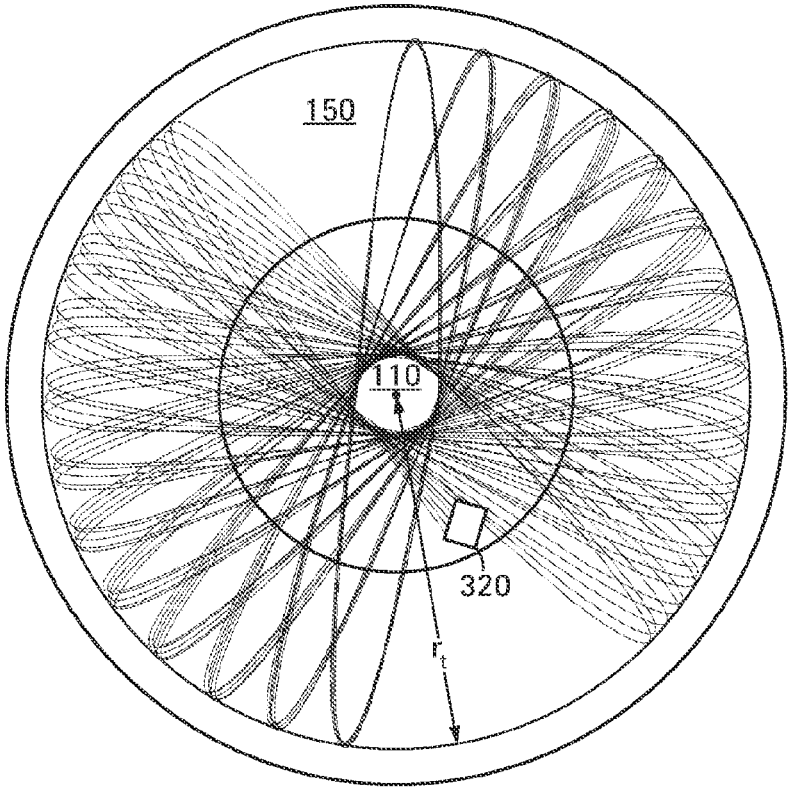
FIG. 11 is a plan view showing of the trajectories of five identical ions having different combinations of injection energy and radial injection position in the electric field represented by the graph shown in FIG. 9.

FIG. 11 is a plan view showing of the trajectories of five identical ions having the following combinations of injection energy and radial injection position: $(E_0, r_0)$, $(E_0, (r_0+\Delta r_0))$, $(E_0, (r_0-\Delta r_0))$, $((E_0+\Delta E_0), r_0)$ and $((E_0-\Delta E_0), r_0)$ for an example in which the radial variation of electric potential in mirror region 550 has the two different slopes shown in FIG. 9. In the example shown in FIG. 10, the radial variations in electric potential in mirror region 550 are configured such that ion turn-around radius $r_t$ is 2.5 times the radius $r_1$ (not shown, but see FIG. 8) of central region 110 and radius $r_0$ (not shown, but see FIG. 8) is 0.3 times the radius $r_1$ of central region 110. Additionally, $\Delta E_0/E_0=\Delta r_0/r_0=0.02$. Radius $r_5$ of electrode 556

(FIG. 9) is equal to 2.05 times the radius $r_1$ of central region 110, and the electric potential $V_5$ at the junction between inner radial region 552 and outer radial region 554 (FIG. 9) is 0.545 times the electric potential at ion turn-around radius $r_t$. In the example shown, the trajectories of the five ions form an isochronous ion front that allows the aberrations resulting from the ions having both a radial injection position spread and an injection energy spread to be eliminated, to first order, simply by appropriately orienting the ion-receiving surface of ion detector 320 to match the tilt of the ion front. Moreover, in the example shown, the ions execute as many as twelve orbits before the trajectory begins to overlap itself.

Approximate Out-of-Plane Dynamics

Figure 12:
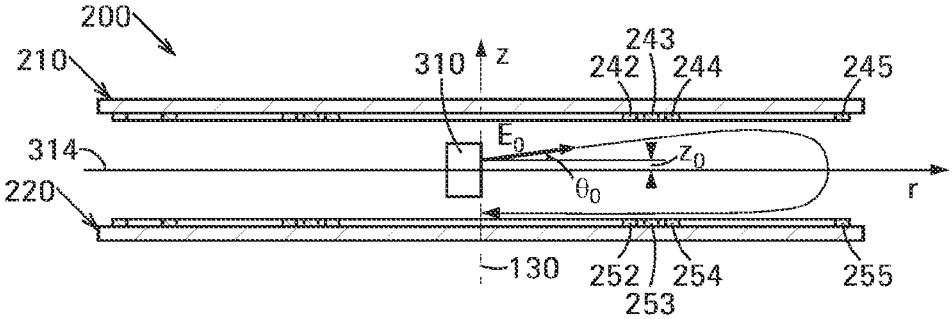
FIG. 12 is a cross-sectional view illustrating ion motion in a plane orthogonal to the plane of the ion trajectories.

A simplified model of a mass analyzer in accordance with an embodiment of the invention will now be described to aid in developing a description of the dynamics of the ions in a plane orthogonal to the two-dimensional plane of the ion trajectories, and to show the dominant time-of-flight aberrations and the corrections allowed. FIG. 12 is a cross sectional view of the simplified model in a z-r plane, orthogonal to the plane of the ion trajectories. The simplified model ignores ion motion in the plane of the ion trajectories, and analyzes ion motion in the z-r plane shown in FIG. 12. The two-dimensional region of interest is bounded by electrode structures 210, 220 in the axial direction and, in the example shown, is essentially unbounded in the r direction. Alternatively, in a manner similar to that which will be described below with reference to FIG. 13B, the region of interest is bounded in the r direction by a conductive cylindrical boundary wall extending between the radially-outer edges of electrode 245 and electrode 255. Electrodes 242-245 and 252-255 are held at fixed voltages to generate electric potentials generally having the form shown in FIG. 1A. The distribution of electric potential defines axially-focusing lens region 140 and mirror region 150 of electric field 100 shown in FIG. 1A.

Ion injector 310 is located at a radius r=0 in the plane shown in FIG. 12 and, in the axial direction, is centered on a median plane 314 located at z=0. Ions injected by ion injector 310 have an axial injection position spread, an axial injection angle spread and an injection energy spread. The dynamic properties of the two-dimensional model shown in FIG. 12 are analyzed in great detail by A. Verentchikov et al. in 50 TECH PHYSICS, 73-81 (2005) and the results of that analysis are described below.

A single half-orbit is defined as the trajectory of an ion starting from axis of symmetry 130 at r=0, which is also the z-axis, travelling out towards mirror region 150 and returning to the z-axis. The time of flight T for the half-orbit depends upon ion injection energy $E_0$, axial injection position $z_0$ from meridian plane 314, and axial injection angle $\theta_0$ between the initial direction of travel of the ion and meridian plane 314. Defining the nominal half-orbit time of flight for an ion with injection energy $E_0$ as T and setting axial injection position $z_0$ and axial injection angle $\theta_0$ to zero, then, for small values of injection energy spread $\Delta E_0$, axial injection position spread $\Delta z_0$ and axial injection angle spread $\Delta\theta_0$, half-orbit time of flight T can be expanded about $T_0$ as a power series in spreads $\Delta E_0$, $\Delta z_0$ and $\Delta\theta_0$. Moreover, due to symmetries, some of the terms in the expansion vanish, e.g., odd-order terms in $\Delta z_0$ and $\Delta\theta_0$ vanish due to reflection symmetry about meridian plane 314. The resulting variation $\Delta T$ in half-orbit time of flight T is the origin of the time-of-flight aberrations that would negatively impact mass resolution.

To minimize time-of-flight aberrations, the radii of annular electrodes 242-245 and 252-255 (FIGS. 2A, 2B) and the voltages applied to the electrodes are selected to impose a time focus on the ions as the ions complete each half orbit. This is implemented in the following way. First, the voltages applied to electrodes 242, 243, 244, 252, 253, 254 that define axially-focusing lens region 140 (FIG. 1A) are set to subject the ions to first-order spatial focusing. The focusing provided by lens region 140 is point-to-parallel focusing in which any ion injected by ion injector 310 located on the axis of symmetry 130 and in median plane 314, i.e., at an axial injection position $z_0=0$, will return to axis of symmetry 130 after reflection by electric field 100 in mirror region 150 with a velocity parallel to the r-axis, i.e., $\theta_z=0$. Similarly, any ion injected by ion injector 310 at axis of symmetry 130 with an axial injection angle $\theta_0=0$ will return to axis of symmetry 130 after reflection by electric field 100 in mirror region 150 and will pass through meridian plane 314 at the axis of symmetry. Additionally, the voltages applied to the remaining electrodes are set to provide second-order time focusing with respect to axial injection position spread $\Delta z_0$, where the quadratic dependence of the half-orbit time of flight T on $\Delta z_0$ is made to vanish. As a result of the symmetry properties of the simplified model, a set of relationships called symplectic conditions can be used to show that, with the first and second order focusing just described, half-orbit time of flight T is independent of both of the injection conditions $\Delta z_0$ and $\Delta\theta_0$ in the second-order approximation.

A simplified model in which each electrode structure 210, 220 is composed of four concentric, annular electrodes essentially has five degrees of freedom that can be optimized. The degrees of freedom are the respective voltages applied to the four electrodes of the electrode structures, and the ratio of the radius $r_1$ of central region 110 to the thickness (axial dimension) of minor region 150. Two of these degrees of freedom can be used to enforce the spatial focusing just described, and the remaining three degrees of freedom can be used to perform third-order energy compensation of the half-orbit time of flight T.

Aberrations in the half-orbit time of flight T can be minimized by performing numerical optimization routines that adjust the four voltages and the radius $r_1$ of central region 110. The half-orbit time-of-flight focus has the desired characteristics of being independent of axial injection position spread $\Delta z_0$ and axial injection angle spread $\Delta\theta_0$ through second-order, and independent of injection energy spread $\Delta E_0$ through third order. An additional electrode and respective independent voltage can be advantageously added to each electrode structure in the simplified model in a manner similar to that described above with reference to FIGS. 9 and 10 to provide an additional degree of freedom in the optimization process. This allows the optimization constraints on the radius $r_1$ of central region 110 to be relaxed, while still achieving the same minimization of the half-orbit time-of-flight aberrations.

Full Three-Dimensional Analysis

A full three-dimensional model of a mass analyzer in accordance with an embodiment of the invention will now be described. The following description builds on the description set forth above of the time-of-flight aberrations of a simplified model of a mass analyzer in accordance with an embodiment of the invention in the radial plane of the ion trajectories and in the axial plane orthogonal to the radial plane. The following description also builds on the description set forth above of the degrees of freedom and methods of performing time focusing that reduce time-of-flight aberrations in each of the radial and axial planes.

A complete three-dimensional description of an ion's trajectory, and, consequently, the time of flight of the ion, requires that six parameters describing the injection conditions of the ion be defined. Three of the parameters describe the ion's position, and the remaining three parameters describe the ion's velocity. As noted above, the acceptance volume of a mass analyzer is the volume of a six-dimensional injection condition space, or phase space. The time-of-flight aberrations of ions whose injection conditions fall within the acceptance volume will be sufficiently small that a specified mass resolution is obtained. A realistic evaluation of mass analyzer performance involves simulating ion trajectories and times-of-flight for ions injected with a distribution of possible injection conditions that spans the acceptance volume. Increasing the acceptance volume increases the analyte sensitivity of the mass analyzer and therefore is an important performance metric.

In a time-of-flight mass spectrometer in which the ion injector subjects ions initially travelling in an axial direction to acceleration in the tangential direction, the ions' velocity spread in the direction of acceleration causes the resulting ion packet to have a fixed time spread that depends on the ion injector, and not on the mass analyzer itself. The fixed time spread is known as turn-around time and is not a fundamental characteristic of the mass analyzer. Accordingly, the turn-around time is not considered in the acceptance volume calculations discussed here. The positional spread of the ions in the direction of acceleration subjects the ions injected into the mass analyzer to an energy spread. Therefore, the performance of the mass analyzer depends in part on the ability of the mass analyzer to tolerate the ions having an energy spread. Of the four remaining variables, two are considered directly as injection position spreads and two as injection angle spreads of the initial velocity vector relative to the mean direction of travel.

Figure 13A:
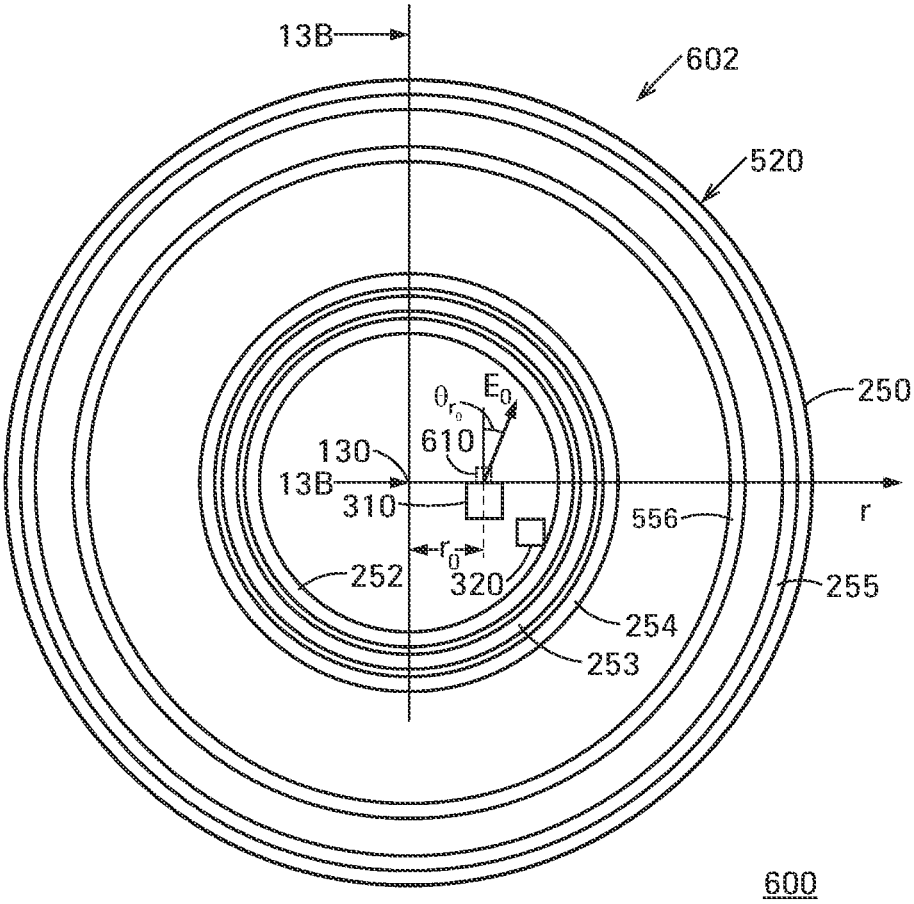
FIGS. 13A and 13B are respectively a plan view and a cross-sectional view along section line 13B-13B showing an example of a mass spectrometer in accordance with another embodiment of the invention.
Figure 13B:
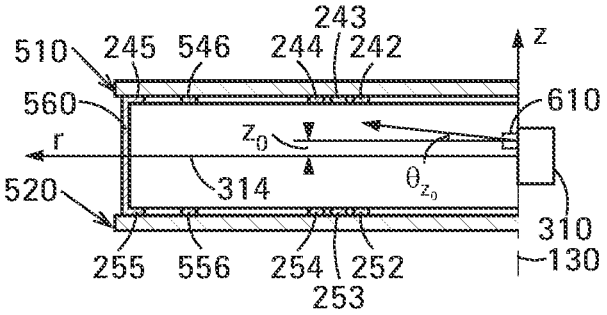

FIGS. 13A and 13B are respectively a plan view and a cross-sectional view showing an example of a mass spectrometer 600 in accordance with an embodiment of the invention that will be used to describe the full three-dimensional analysis. Mass spectrometer 600 is composed of a mass analyzer 602 in accordance with another embodiment of the invention, ion injector 310 and ion detector 320. Mass analyzer 602 is composed of electrode structure 520 described above with reference to FIG. 10, and an electrode structure 510 identical to electrode structure 520 disposed opposite, concentric with and axially offset from electrode structure 520. A conductive cylindrical boundary wall 560 extends axially between the radially-outer edge of the outermost electrode 245 of electrode structure 510 and the radially-outer edge of the outermost electrode 255 of electrode structure 520. Boundary wall 560 additionally defines the axial separation between electrode structure 510 and electrode structure 520. Additionally, boundary wall 560 and electrode structures 510, 520 can be provided with positive indexing features that precisely define the position in the radial plane of each electrode structure 510, 520 relative to the boundary wall. Thus, such embodiment of boundary wall 560 defines the position of each electrode structure 510, 520 relative to the other both radially and axially. Additionally, a spacer extending between electrode structure 510 and electrode structure 520 may be located at or near the center of central region 110.

FIGS. 13A and 13B additionally show the coordinates of the injection position of an ion packet 610 and vectors representing the injection direction of the ion packet. The mean injection energy of the ion packet is denoted $E_0$, and the injection energy spread of the ions within the ion packet is denoted $\Delta E_0$. In the radial plane shown in FIG. 13A, the mean radial injection position of ion packet 610 relative to axis of symmetry 130 is $r_0$. The radial injection position spread of the ions within ion packet 610 is denoted $\Delta r_0$. Moreover, the mean radial injection angle $\theta_{r_o}$ of ion packet 610 relative to the tangential direction, i.e., the normal to the radius extending from axis of symmetry 130 to ion injector 310, is zero. The radial injection angle spread of the ions within ion packet 610 relative to the tangential direction is $\Delta\theta_{r_o}$.

In the axial (z-r) plane shown in FIG. 13B, the mean axial injection position $z_0$ of ion packet 610 relative to median plane 314 (z=0) is zero, and the axial injection position spread of the ions within the ion packet about median plane 314 is $\Delta z_0$. The mean axial injection angle $\theta_{z_o}$ of ion packet 610 relative to median plane 314 is zero and the axial injection angle spread of the ions within the ion packet relative to median plane 314 is $\Delta\theta_{z_o}$.

To determine the mass resolution for ion packet 610, numerical calculations were performed to find the time of flight for each ion within the ion packet. Trajectory simulations were performed using version 8.03 of an ion optics modeling program sold under the trademark SIMION® by Scientific Instrument Services, Inc., Ringoes, N.J. Data representing the cylindrically-symmetric electric field generated by applying a voltage pattern to the electrodes of opposed electrode structures 510, 520 was input to the program. The program computed the mean and full-width half-maximum of the times of flight, and the computed mean and full-width half-maximum of the times of flight were used to find the time-of-flight aberration-limited mass resolution.

Figure 14A:
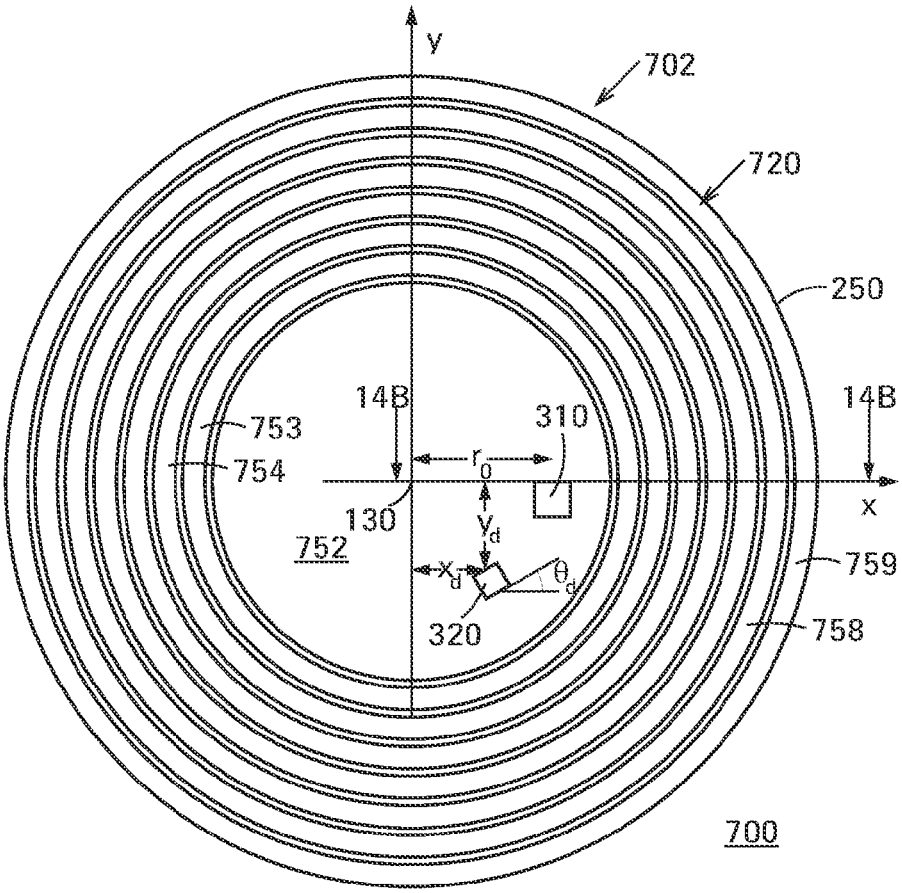
FIGS. 14A and 14B are respectively a plan view and a cross-sectional view along section line 14B-14B showing an example of a mass spectrometer in accordance with another embodiment of the invention.
Figure 14B:
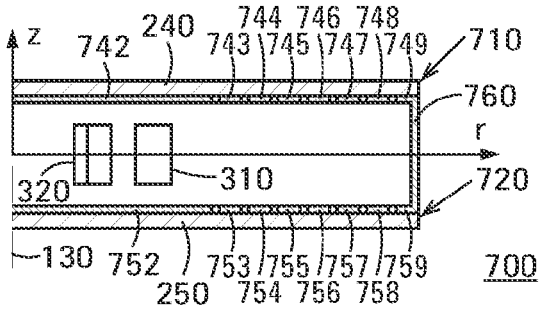

FIGS. 14A and 14B are respectively a plan view and a half cross-sectional view showing a practical example 700 of a mass spectrometer in accordance with another embodiment of the invention designed using the parameter optimization process described above. Mass spectrometer 700 is composed of a mass analyzer 702 in accordance with another embodiment of the invention, ion injector 310 and ion detector 320. In FIG. 14A, electrode structure 710 has been removed to reveal electrode structure 720, ion injector 310 and ion detector 320. The full three dimensional structure of mass analyzer 702 is obtained by rotating the half cross-sectional view shown in FIG. 14B one full rotation about axis of symmetry 130.

Mass analyzer 702 is composed of an electrode structure 710 and an electrode structure 720. In the example shown, electrode structure 710 is composed of planar insulating substrate 240, a circular, central electrode and annular electrodes concentric with and surrounding the central electrode. The electrodes are mechanically coupled to and collectively cover a majority of the surface area of one of the major surfaces of substrate 240. The example of electrode structure 710 shown has a central electrode 742 and seven annular electrodes 743, 744, 745, 746, 747, 748 and 749. The annular electrodes have nominally equal radial widths. Electrode structure 720 is composed of a planar insulating substrate 250, a circular central electrode and annular electrodes concentric with and surrounding the central electrode. The electrodes are mechanically coupled to and collectively cover a majority of the surface area of one of the major surfaces of substrate 250. The example of electrode structure 720 shown has a central electrode 752 and seven annular electrodes 753, 754, 755, 756, 757, 758 and 759 nominally identical to electrodes 743, 744, 745, 746, 747, 748 and 749, respectively. Central electrodes 742, 752 each have a radius nominally equal to the radius $r_1$ of central region 110 shown in FIG. 1A. A conductive cylindrical boundary wall 760, similar to boundary wall 560 described above with reference to FIGS. 13A, 13B, extends axially between the radially-outer edge of the outermost electrode 749 of electrode structure 710 and the radially-outer edge of the outermost electrode 759 of electrode structure 720.

Electrode structure 720 is disposed parallel to electrode structure 710 with electrodes 752-759, facing electrodes 742-749, parallel to electrodes 742-749 and offset from electrodes 742-749 in the direction of axis of symmetry 130. Moreover, the centers of electrodes 742-749 and electrodes 752-759 are centered on axis of symmetry 130. Thus, electrode structure 720 can be regarded as being disposed opposite, parallel to, concentric with, and axially offset from electrode structure 710. Other examples of electrode structures 710, 720 have more or fewer than the seven annular electrodes of the example shown. A greater number of electrodes provides more degrees of freedom and, hence, the ability to compensate for time-of-flight aberrations more precisely. As described above, each electrode structure 710, 720 has at least four electrodes to enable mass analyzer 702 to provide simultaneous third-order energy compensation and second-order spatial compensation. Each electrode structure 710, 720 having only four electrodes additionally requires that innermost electrodes 742, 752 have a particular, advantageous radius. Five or more electrodes allow the constraint on the radius of the innermost electrodes to be relaxed.

Also as discussed above, the simultaneous compensation of the time-of-flight aberrations resulting from injection energy spread, radial injection position spread and radial injection angle spread also depends on the location and angular orientation of ion detector 320 within mass analyzer 702. FIG. 14A additionally shows the position $x_d$, $y_d$ of ion detector 320 relative to the x- and y-axes that intersect axis of symmetry 130, and the angular orientation $\theta_d$ of the ion-receiving surface of the ion detector relative to the x-axis.

A simplex optimization algorithm was used to determine the voltages constituting the voltage pattern applied to electrode structures 710, 720, and the position and angle of ion detector 320 that yield the highest mass resolution for a given distribution of ion injection conditions (position and velocity). For simplicity and computational expediency, the optimization process is divided into two parts. The first part uses a single reflection of the ions by the electric field in mirror region 150 (FIG. 1A) and converges upon optimum values of the voltages constituting the voltage pattern. The second part of the optimization process simulates the full number of reflections and converges upon the optimum position and angle of ion detector 320 with the voltage pattern determined in the first part applied to the electrode structures.

The first part of the optimization process in which the voltage pattern is optimized uses a defined distribution of ion injection conditions containing only an injection energy spread $\Delta E_0$, an axial injection position spread $\Delta z_0$ and an axial injection angle spread $\pm\Delta\Theta_{z_0}$. Additionally, a single value of injection radius $r_0$ and a radial injection angle of zero ($\theta_{r_0}=0$) relative to the tangential direction are used. A voltage pattern that, when applied to the electrodes, compensates for the defined injection energy spread to third order, and the defined axial injection position spread and axial injection angle spread to second order is determined. Including both the axial injection position spread ($\Delta z_0$) and the axial injection angle spread ($\Delta\theta_{z_0}$) in the ion injection conditions ensures point-to-parallel focusing in the z-plane. To realize the ideal single-reflection configuration, the voltage pattern is optimized to provide a time focus after one half orbit at a fixed position offset from the x-axis by 2 mm in the −y-direction. The ion receiving surface of ion detector 320 is oriented parallel to the x-axis and is offset from the x-axis by 2 mm in the −y-direction so that it is located at the position of the time focus. Ion detector 320 is assumed to be infinitely long in the x-direction at this point in the discussion. The limited distribution of the ion injection conditions and restricting the trajectory of the ions to a single reflection accelerates and simplifies the first part of the optimization process.

By performing the first part of the optimization to provide a time focus displaced by 2 mm from the x-axis after one half orbit, the time focus translates away from axis of symmetry 130 by an additional 2 mm per half orbit. Consequently, in the second part of the optimization in which the ions execute several half orbits, the half-orbit displacements accumulate so that the time focus is located centimeters away from the axis of symmetry. This allows ion detector 320 to be positioned where it intercepts the desired orbit, but does not interfere with adjacent ion orbits. The slight shift of the time focus away from the origin causes minimal degradation of the mass resolution. The ability to compensate for the specified injection energy spread, axial injection position spread and axial injection angle spread using a voltage pattern applied to annular electrodes that generate a cylindrically-symmetric electric field through which the ions execute successive high aspect ratio elliptical orbits that precess enables a mass analyzer in accordance with an embodiment of the invention to achieve a high mass resolution within a compact evacuated space. In an example, the voltages constituting the voltage pattern are optimized for ions having a mean kinetic energy equal to 7000 eV within central region 110. The voltages determined by the first part of the optimization process remain fixed during the remainder of the optimization process.

An initial location of ion detector 320 is selected to coincide with the time focus of the ions after the ions have executed a desired number of orbits. The number of orbits is the largest number of orbits that the ions can execute without any of the orbits overlapping or interfering with one another since, after ion injector 310 has injected a packet of ions having different masses, the differing injection velocities and positions of the ions of different masses may well cause the ions to be distributed among more than one of the orbits. A final location of ion detector 320 is determined using a simplex algorithm to calculate an offset $y_d$ of the ion detector from the x-axis and angle $\theta_d$ of the ion-receiving surface of the ion detector relative to the x-direction that maximize the mass resolution. During the second part of the optimization process, only the injection energy spread and the radial injection position spread of the ions within the ion packet are specified. Specifying only the injection energy spread and the radial injection position spread as just described is adequate to locate the position of the time focus and also to determine the angle of the ion detector that both simultaneously compensate for the injection energy spread and the radial injection position spread as described above with reference to FIGS. 4A, 4B and 5. It should be noted that radial injection angle spread $\Delta\Theta_{r_0}$ causes a fixed time error that does not grow with the number of orbits executed by the ions.

With all of the above-described parameters optimized, the mass resolution can be evaluated with an ion injection distribution containing non-zero values in all five relevant dimensions (axial and radial injection position spread, axial and radial injection angle spread and injection energy spread).

Practical Example

Design parameters for a practical example of mass spectrometer 700 are as follows:

| | |
|---|---|
| Radius of electrodes 742, 752 | 218 mm |
| Radial width of annular electrodes 743-748, 753-758 | 13 mm |
| Radial width of annular electrodes 749, 759 | 6.5 mm |
| Radial spacing between adjacent electrodes | 2.0 mm |
| Axial offset between central electrodes 742, 752 | 32 mm |

Voltage pattern applied to electrodes:

| Electrodes | 742/752 | 743/753 | 744/754 | 745/755 |
|---|---|---|---|---|
| Voltage (kV) | 0 | −13.636 | −14.899 | 2.066 |
| Electrodes | 746/756 | 747/757 | 748/758 | 749/759 |
| Voltage (kV) | 1.991 | 7.004 | 6.935 | 9.411 |

Properties of Ion Injector 310:
Energy $E_0$: 7 keV
Radial injection position $r_0$: 12.0 mm
Radial injection angle $\theta_{r_0}$: 0 degrees
Axial injection position $z_0$: 0 mm
Axial injection angle $\theta_{z_0}$: 0 degrees
Injection energy spread $\Delta E_O$: 200 eV
Radial injection position spread $\Delta r_0$: 0.4 mm
Radial injection angle spread $\Delta\theta_{r_0}$: 0.5 degrees
Axial injection position spread $\Delta z_0$: 5 mm
Axial injection angle spread $\Delta\theta_{z_0}$: 1.5 degrees
Properties of Ion Detector 320:
Offset from x-axis $y_d$: −63 2 mm
Offset from y-axis $x_d$: 13.0 mm
Ion receiving face orientation $\theta_d$: 24.5 degrees
Predicted Operating Results:
Mean time of flight: 624 μs
FWHM time-of-flight spread: 1.58 ns
Mass resolution: 197,000

FIGS. 15A-15G are cross-sectional views showing a representative portion of a number of different implementations of electrode structure 210 described above with reference to FIGS. 2A and 2B. Corresponding implementations for electrode structure 220 will not be separately described. The electrode assemblies of the other mass analyzers in accordance with the various embodiments of the invention described herein may have similar implementations. The portion of electrode structure 210 shown in FIGS. 15A-15G is the portion in which electrodes 243 and 243 are located. The remainder of electrode structure 210 is similar in structure in each of the implementations. In all of the implementations shown in FIGS. 15A-15G, the material of electrodes 243 and 243 is a metal such as aluminum, copper, stainless steel, or a nickel-iron alloy sold under the registered trademark INVAR®.

Figure 15A:
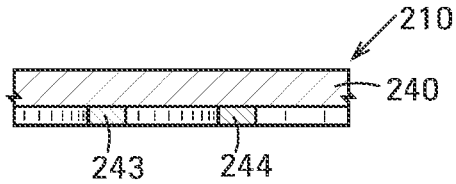
FIGS. 15A-15G are cross-sectional views showing a representative portion of a number of different implementations of one of the electrode structures shown in FIGS. 2A and 2B.
Figure 15B:
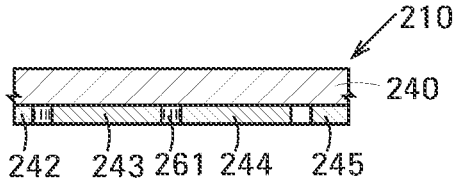

In the implementations shown in FIGS. 15A and 15B, the material of substrate 240 is an insulating material such as glass, ceramic or plastic typically having a resistivity at least $10^3$ times that of the material of the electrodes. In the implementation shown in FIG. 15A the width in the radial direction of electrodes 243 and 244 is smaller than the offset in the radial direction between the electrodes. In the implementation shown in FIG. 15B, electrodes 243 and 244 are separated by a small gap 261 in the radial direction. Gap 261 is no wider than the distance needed to prevent arcing between the electrodes and surface breakdown along the surface of substrate 240 between the electrodes. Adjacent ones of the remaining electrodes are separated by respective gaps similar in width to gap 261. In an example, the metal layer of a suitably-sized sheet of printed circuit material having an epoxy, PTFE, ceramic, glass or another suitable high-resistivity material substrate is selectively etched to define electrodes 243, 244 and the remaining electrodes of electrode structure 210. Photolithography-based selective etching techniques are well known in the art and may be used.

Figure 15C:
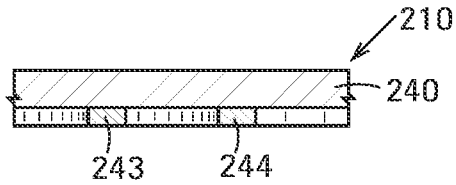

In the implementation shown in FIG. 15C, the material of substrate 240 has a resistivity intermediate between that in the implementations shown in FIGS. 15A and 15B and that of electrodes 243, 244, and the width in the radial direction of electrodes 243 and 244 is smaller than the offset in the radial direction between the electrodes. The resistivity of substrate 240 is typically in the range from $10^5$ to $10^8$ ohm-cm. Typical substrate materials include conductive glass (typical resistivity $2\times10^6$ ohm-cm), and a synthetic resinous plastic material sold under the registered trademark VESPEL® loaded with sufficient carbon to provide resistivity of about $5\times10^7$ ohm-cm. In the implementation shown in FIG. 15C, when different voltages are applied to electrodes 243, 244, the voltage on the surface of substrate 240 between electrodes 243, 244 changes progressively with increasing radius from the voltage applied to electrode 243 to the voltage applied to electrode 244 due to the conductivity of substrate 240. For example, at a point on the surface of substrate 240 radially mid-way between electrodes 243 and 244, the voltage on the surface of substrate 240 is approximately mid-way between the voltages applied to electrodes 243 and 244.

In an example, a suitably-sized sheet of printed circuit material having a substrate of conductive glass, carbon-loaded epoxy, PTFE, or resinous plastic or another suitable substrate material is selectively etched to define electrodes 243, 244 and the remaining electrodes of electrode structure 210. Photolithography-based selective etching techniques are well known in the art and may be used.

Figure 15D:
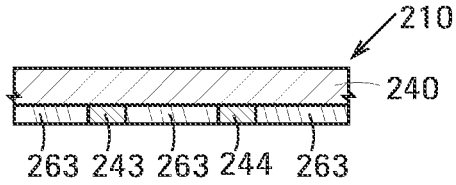

In the implementation shown in FIG. 15D, the material of substrate 240 is an insulating material such as one of the insulating materials described above with reference to FIGS. 15A and 15B, the width in the radial direction of electrodes 243 and 244 is smaller than the offset in the radial direction between the electrodes, and a layer 263 of intermediate-resistivity material is deposited in the gap between electrodes 243, 244. The material of layer 263 has a resistivity intermediate between that of substrate 240 and that of electrodes 243, 244. Typical materials for layer 263 include conductive glass and conductive ink. Suitable materials for substrate 240 are described above with reference to FIGS. 15A, 15B. In the implementation shown in FIG. 15D, when different voltages are applied to electrodes 243, 244, the voltage on the surface of layer 263 changes progressively with increasing radius from the voltage applied to electrode 243 to the voltage applied to electrode 244 due to the conductivity of layer 263. For example, at a point on the surface of layer 263 radially mid-way between electrodes 243 and 244, the voltage on the surface of layer 263 is approximately mid-way between the voltages applied to electrodes 243 and 244.

In an example, the metal layer of a suitably-sized sheet of printed circuit material having an epoxy, PTFE, ceramic, glass or other suitable high-resistivity material substrate is selectively etched to define electrodes 243, 244 and the remaining electrodes of electrode structure 210. Photolithography-based selective etching techniques are well known in the art and may be used. In an example, conductive glass is then selectively deposited by evaporation in a reducing atmosphere on the surface of substrate 240 in the gaps between the electrodes and in electrical contact with the electrodes to provide layer 263. In another example, conductive ink is then selectively deposited by screen printing or ink jetprinting on the surface of substrate 240 in the gaps between the electrodes and in electrical contact with the electrodes. The electrode structure is then heated to form layer 263 from the conductive ink.

Figure 15E:
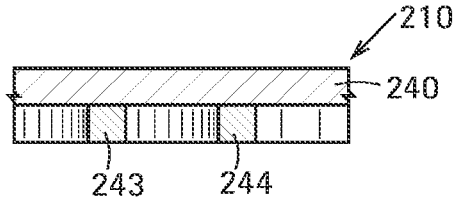

In the implementation shown in FIG. 15E, electrodes 243, 244 are fabricated independently of substrate 240 and then are affixed to substrate 240. In an example, a bar of electrode material having a square, rectangular, elliptical or other suitable cross-sectional shape is formed into an approximately circular shape, and the juxtaposed ends of the bar are joined together, e.g., by soldering or welding, to form a respective electrode having a roughly annular shape. Typically, the electrode is then subject to additional forming work to define the final annular shape of the electrode. In another example, a sheet of electrode material is subject to a punching or cutting operation that forms a complete set or a subset of annular electrodes. Other ways of forming the electrodes are known and may be used. The electrodes may be radially narrow, similar to the example shown in FIG. 15A, radially wide, similar to the example shown in FIG. 15B, or of intermediate radial width.

Substrate 240 is a sheet of an insulating material such as one of the insulating materials described above with reference to FIGS. 15A and 15B. Alternatively, substrate 240 is a sheet of material of intermediate resistivity similar to that described above with reference to FIG. 15C. Electrodes 243, 244 and the remaining electrodes are affixed to substrate 240 by fasteners such as screws, rivets or other suitable fasteners, or by a suitable adhesive. In examples in which substrate 240 is a sheet of material of intermediate resistivity, the adhesive is an electrically-conductive adhesive. A jig may be used to ensure that the electrodes are precisely concentric. A layer of intermediate-conductivity material similar to that described above with reference to FIG. 15D may be deposited on the surface of substrate 240 before or after the electrodes have been affixed to the substrate.

Figure 15F:
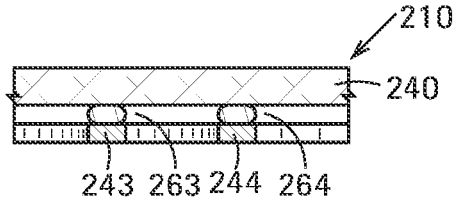

In the implementation shown in FIG. 15F, the material of substrate 240 is an electrically-conductive material; electrodes 243, 244 are fabricated independently of substrate 240 and then are affixed to substrate 240 using insulators. Typically, the material of substrate 240 is a metal, typically stainless steel, aluminum, a nickel-iron alloy or another suitable metal. The electrodes are fabricated in a manner similar to that described above with reference to FIG. 15E. Insulators 263, 264 are affixed to substrate 240 by fasteners such as screws, rivets or other suitable fasteners, or by a suitable adhesive, and electrodes 243, 244 are affixed to insulators 263, 264 by fasteners (not shown) such as screws, rivets or other suitable fasteners, or by a suitable adhesive (not shown). Alternatively, insulators 263, 264 may be affixed to electrodes 243, 244 before being affixed to the substrate. The remaining electrodes (not shown) are similarly affixed to substrate 240 using insulators. A jig may be used to ensure that the electrodes are precisely concentric.

Figure 15G:
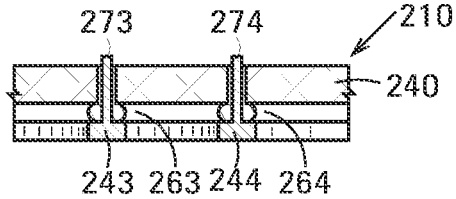

The implementation shown in FIG. 15G is similar to that shown in FIG. 15F. In the implementation shown in FIG. 15G, at least one of the insulators 263, 264 supporting electrodes 243, 244, respectively, is configured to extend through metal substrate 240 in a direction orthogonal to the major surface of the substrate. Additionally, conductive feed-throughs 273, 274 extend through insulators 263, 264, respectively, into electrical contact with electrodes 243, 244, respectively. Feed-throughs 273, 274 constitute part of electrical connections 230 (FIG. 2B) that apply the first pattern of voltages to the electrodes, including electrodes 243, 244, that constitute part of electrode structure 210. At least one of the insulators supporting each of the remaining electrodes constituting electrode structure 210 is similar in structure to insulators 273, 274.

In a mass spectrometer, electrode structure 210, electrode structure 220, ion source 310 and ion detector 320 are housed within a substantially cylindrical vacuum chamber (not shown). In the implementations shown in FIG. 15F and FIG. 15G, the vacuum chamber has two circular walls disposed opposite one another. In some embodiments, the opposed circular walls respectively provide the substrate 240 of electrode structure 210 and the substrate 250 of electrode structure 220.

In the implementations shown in FIGS. 15F and 15G, substrate 240 can alternatively be composed of an insulating material such as one of the insulating materials described above with reference to FIGS. 15A and 15B. An insulating substrate reduces the possibility of surface breakdown between adjacent electrodes. Other configurations of electrode structure 210 are possible and may be used.

Figure 16:
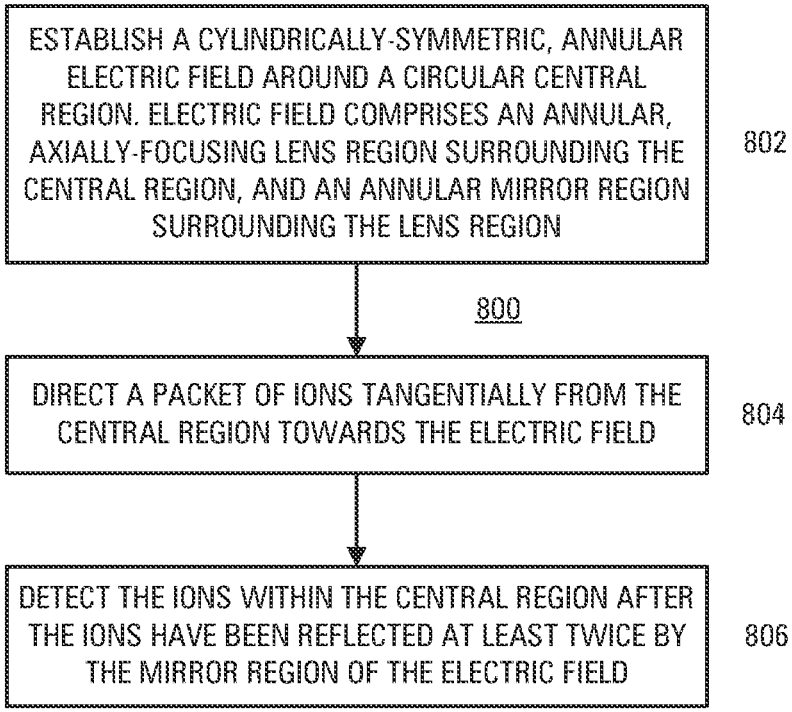
FIG. 16 is a flow chart showing an example of a mass spectrometry method in accordance with another embodiment of the invention.

FIG. 16 is a flow chart showing an example of a mass spectrometry method 800 in accordance with an embodiment of the invention. In block 802, a cylindrically-symmetric, annular electric field is established around a circular central region. The electric field comprises an annular, axially-focusing lens region surrounding the central region, and an annular mirror region surrounding the lens region. In block 804, a packet of ions is directed tangentially from the central region towards the electric field. In block 806, the ions are detected within the central region after the ions have been at least twice reflected by the mirror region of the electric field.

In an embodiment, in block 802, establishing the electric field comprises establishing a radially-increasing electric potential within the mirror region. In another embodiment, establishing the electric field comprises establishing an electric potential radially-increasing with a first slope in a first radial region and establishing an electric potential radially-increasing with a second slope in a second radial region, the first slope different from the second slope, the first radial region different from the second radial region. In yet another embodiment, establishing the electric field comprises configuring the electric field to provide temporal focusing of the ions after reflection of the ions by the minor region of the electric field.

Embodiments of Cylindrical Geometry TOF Mass Analyzer Comprising a Central Lens

Embodiments of a cylindrical geometry TOF mass analyzer comprising a central lens are described presently. Many aspects of the embodiments of the cylindrical geometry TOF mass analyzer and mass spectrometer are common to the presently described embodiments. Many common aspects of the cylindrical geometry TOF mass analyzer/mass spectrometer are not repeated to avoid obscuring the presently described embodiments.

Figure 17:
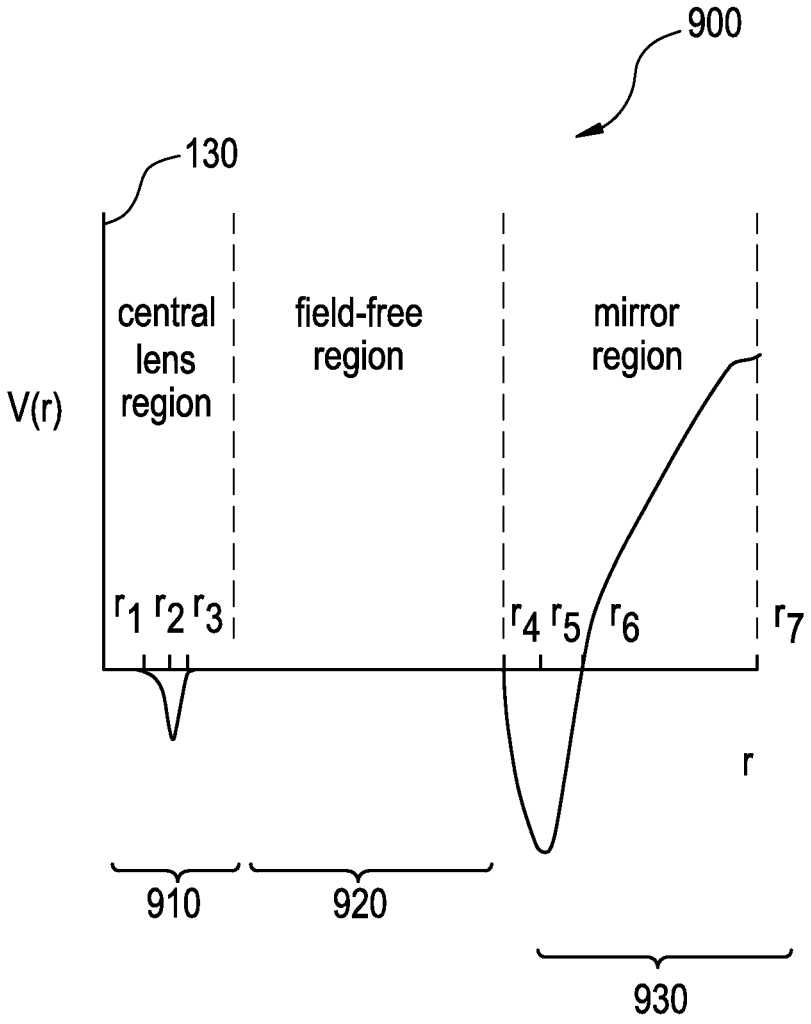
FIG. 17 is a graph showing the radial variation of electric potential in an example of the cylindrically-symmetrical electric field used in a mass analyzer in accordance with a representative embodiment.

FIG. 17 is a graph showing the variation of electric potential V with radius r from the axis of symmetry 130 in an example of a cylindrically-symmetric, annular electric field 900 ("electric field 900") used in a mass analyzer in accordance with a representative embodiment. The electric field 900 comprises an annular radially focusing central lens region 910 ("central lens region 910") surrounding the axis of symmetry 130, and an annular minor region 930 ("mirror region 930") surrounding the central lens region 910. The electric field 900 further comprises an annular field-free region 920 ("field-free region 920") disposed between the central lens region 910 and the mirror region 930.

Referring to FIG. 17, electric field 900 is established in central lens region 910 surrounding the axis of symmetry 130, minor region 930 and the field-free region 920. The central lens region 910, the field-free region 920 and the minor region 930 are all centered on an axis of symmetry 130. Central lens region 910 has a perimeter at a radial distance $r_1$ from axis of symmetry 130. As the radial distance from axis of symmetry 130 increases past radial distance $r_1$, the electric potential of electric field 900 changes steeply to a maximum negative value at a radial distance $r_2$, and then steeply returns to zero at a radial distance $r_3$. The portion of electric field 900 between radial distance $r_1$ and radial distance $r_3$ constitutes the annular radially focusing central lens region 910. As the radial distance from the axis of symmetry 130 increases past radial distance $r_3$, the electric potential is substantially zero, providing field-free region 920. Beginning at a radial distance $r_4$ from the axis of symmetry 130, the electric potential of the electric field 900 changes steeply to another maximum negative value at a radial distance $r_5$ axis of symmetry 130, and then steeply returns to zero at a radial distance $r_6$ from the axis of symmetry 130. In some embodiments, the portion of electric field 900 between radial distance $r_4$ and radial distance $r_6$ constitutes an Einzel lens, which has an axial focusing characteristic. As the radial distance from axis of symmetry 130 increases past radial distance $r_6$, the electric potential of electric field 900 increases progressively to a maximum positive value at a radial distance $r_7$, which corresponds to the outer limit of the electric field. The portion of electric field 900 between radial distance $r_4$ and radial distance $r_7$ constitutes mirror region 930. Notably, the profile of electric field 900 is the same along any radius extending from axis of symmetry 130 at the axial symmetry plane.

In electric field 900, the rapidly-varying electric potential within central lens region 910 subjects ions travelling between $r_1$ and $r_2$ from the axis of symmetry 130 towards the central lens region 910 to a radial force directed away from the axis of symmetry 130; and ions traveling between $r_2$ and $r_3$ from the axis of symmetry 130 to a radial force toward the axis of symmetry 130. Ions traveling at a distance $r_2$ from the axis of symmetry 130 are not deflected by the electric field 900.

As described more fully below, the electric field 900 in the central lens region 910 beneficially reduces, if not eliminates, angular divergence of a beam of ions incident with non-zero spreads in initial radial position, angular divergence and energy spread. Left unchecked, it is found that the ion beam continuously diverges and grows in lateral extent within the plane of the mass analyzer 1001 as it propagates along the flight path, resulting in flight time differences of ions. These flight time differences grow with the degree to which the initial conditions deviate from that of the nominal trajectory defining the center of the beam. Ultimately, the increased lateral beam spread results in decreased analyzer resolution. The increased lateral spread of the beam may also cause a substantial number of the analyte ions to completely miss the detector of the mass spectrometer. Thus, the increased lateral beam spread results in decreased analyzer sensitivity. The increased lateral spread of the ion beam may cause ion trajectories that correspond to different orbit numbers to overlap in the region of the detector. This would lead to spurious peaks occurring in the mass spectrum, as some ions would be detected before performing the prescribed number of orbits. Thus, the increased lateral beam spread results in misidentification of ion species.

Figure 18B:
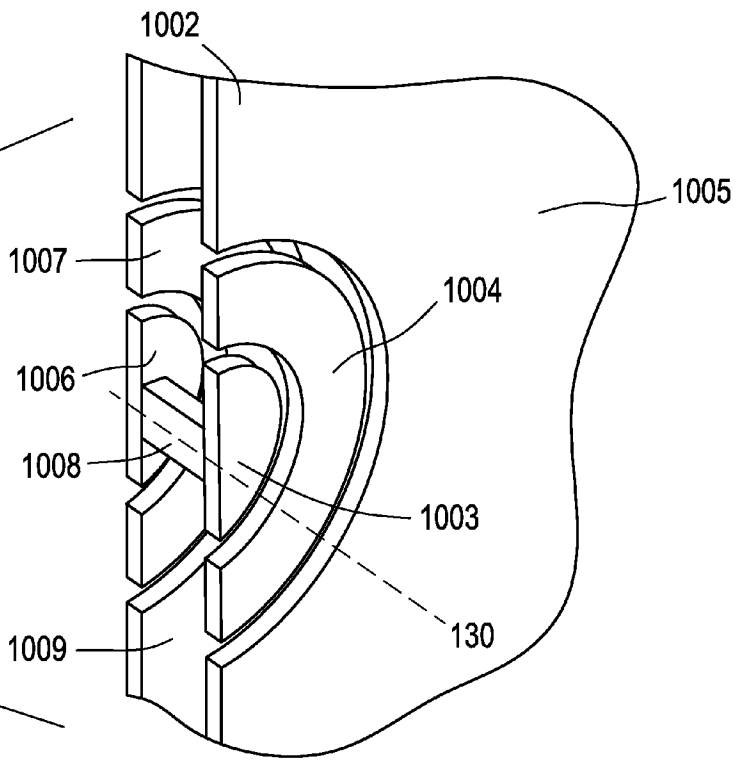
FIG. 18B shows an expanded view of the central lens shown in FIG. 18A.
Figure 18A:
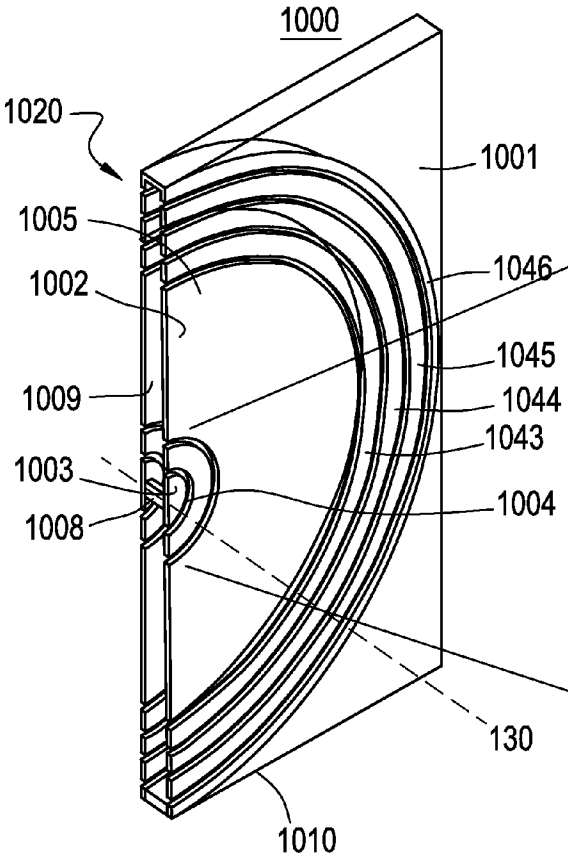
FIG. 18A is an isometric schematic drawing showing a simplified example of a mass analyzer in accordance with a representative embodiment.

FIG. 18A is an isometric schematic view of a portion of a mass spectrometer 1000 in accordance with a representative embodiment. Notably one-half of the mass spectrometer 1000 is depicted. As with certain embodiments described above, the full three dimensional structure of mass spectrometer 1000 is obtained by rotating the half cross-sectional view shown in FIG. 18A one full rotation about axis of symmetry 130. The mass spectrometer 1000 comprises a mass analyzer 1001. Mass analyzer 1001 is composed of an electrode structure 1010 and an electrode structure 1020. In the example shown, electrode structure 1010 is composed of an annular radially focusing central lens 1002 ("central lens 1002") comprising an inner electrode 1003, an intermediate electrode 1004 and an outer electrode 1005. Electrode structure 1010 comprises the central lens 1002 and four annular electrodes 1043, 1044, 1045 and 1046. Inner electrode 1003, intermediate electrode 1004, outer electrode 1005 and annular electrodes 1043~1046 are illustratively concentric about the axis of symmetry 130. The annular electrodes 1043, 1044, 1045 have nominally equal radial widths.

Electrode structure 1020 comprises central lens 1002 comprising an inner electrode 1006, an intermediate electrode 1007 and an outer electrode 1009. An electrically conductive post 1008 extends between inner electrode 1003 and inner electrode 1006, which are maintained at the same electrical potential. Electrode structure 1020 comprises the central lens 1002 and four annular electrodes 1047, 1048, 1049 and 1050. Inner electrode 1006, intermediate electrode 1007, outer electrode 1009 and annular electrodes 1047~1050 are illustratively concentric about the axis of symmetry 130. The annular electrodes 1047, 1048, 1049 have nominally equal radial widths. A conductive boundary wall 1060, similar to conductive cylindrical boundary wall 560 described above with reference to FIGS. 13A, 13B, extends axially between the radially-outer edge of the annular electrode 1047 of electrode structure 1010 and the radially-outer edge of the annular electrode 1051 of electrode structure 1020.

Electrode structure 1020 is disposed parallel to electrode structure 1010 with electrodes 1004, 1005, 1043, 1044, 1045, 1046 facing electrodes 1006, 1007, 1009, 1047, 1048, 1049, 1050 parallel to electrodes 1004, 1005, 1043, 1044, 1045, 1046, and offset from electrodes 1004, 1005, 1043, 1044, 1045, 1046 in the direction of axis of symmetry 130. Moreover, the centers of electrodes 1004, 1005, 1043, 1044, 1045, 1046 and electrodes 1006, 1007, 1009, 1047, 1048, 1049, 1050 are centered on axis of symmetry 130. Thus, electrode structure 1020 can be regarded as being disposed opposite, parallel to, concentric with, and axially offset from electrode structure 1010. Other examples of electrode structures 1010, 1020 have more or fewer than the four pairs of annular electrodes 1043~1050 of the example shown. A greater number of electrodes provides more degrees of freedom and, hence, the ability to compensate for time-of-flight aberrations more precisely. As described above, each electrode structure 1010, 1020 has at least four electrode pairs to enable mass analyzer 1001 to provide simultaneous third-order energy compensation and second-order spatial compensation.

FIG. 18B shows an expanded view of the central lens 1002 shown in FIG. 18A. Specifically, the facing inner electrodes 1003, 1006, the facing intermediate electrodes 1004, 1007 and the electrically conductive post 1008 of the central lens are shown. A portion of outer electrodes 1005, 1009 of electrode structures 1010, 1020, respectively are also shown. In representative embodiments outer electrodes 1005,1009 of the central lens 1002 are maintained at a ground potential (e.g., 0V) so the electric potential at $r_3$ (see FIG. 17) returns to zero and remains at zero radially across the field-free region 920. This provides the desired electric field pattern and corresponding electric potential relationship depicted in FIG. 17.

Figure 19A:
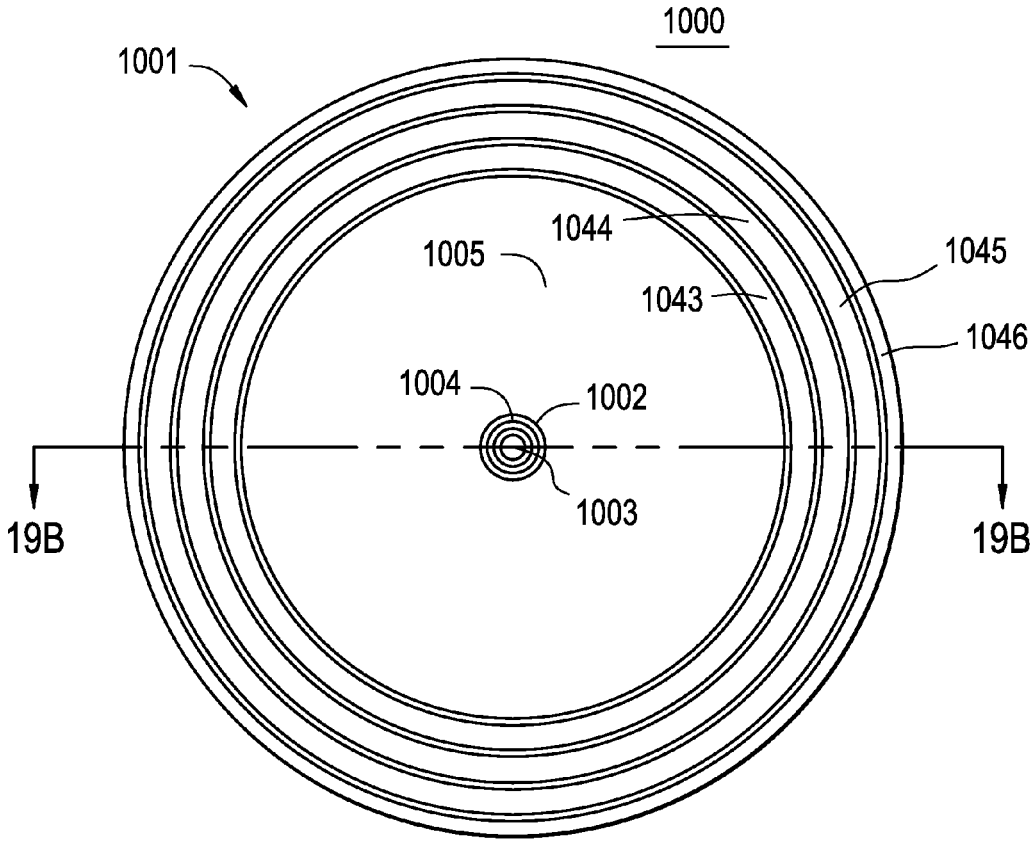
FIG. 19A is a top view of mass analyzer in accordance with a representative embodiment.
Figure 19B:
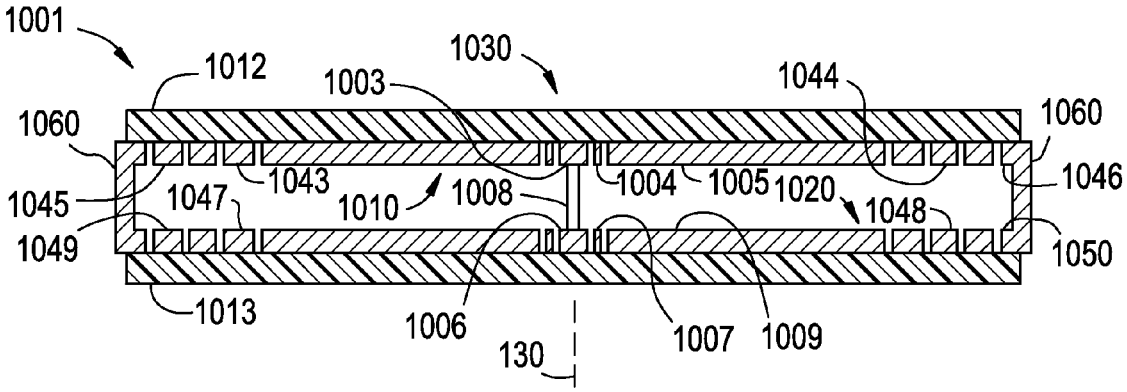
FIG. 19B is a cross-sectional view of the mass analyzer of FIG. 19A taken along section line 19B-19B.

FIGS. 19A and 19B are respectively a plan view and a cross-sectional view showing mass spectrometer 1000 in accordance with another representative embodiment. Mass spectrometer 1000 is composed of mass analyzer 1001 in accordance with another embodiment of the invention, ion injector (not shown in FIGS. 19A-19B) and ion detector (not shown in FIGS. 19A-19B).

Mass analyzer 1001 is composed of electrode structure 1010 and electrode structure 1020. In the example shown, electrode structure 1010 is composed of a central lens 1002 comprising inner electrode 1003, intermediate electrode 1004, and outer electrode 1005. Electrode structure 1010 is composed of an electrically insulating substrate 1012, the central lens 1002 and four annular electrodes 1043, 1044, 1045 and 1046. Inner electrode 1003, intermediate electrode 1004, outer electrode 1005 and annular electrodes 1043~1046 are illustratively concentric about the axis of symmetry 130. The electrode structure 1010 illustratively comprises materials described above in connection with embodiments. Moreover, electrode structure 1010 is illustratively fabricated according to methods described above in connection with embodiments.

Electrode structure 1020 comprises an electrically insulating substrate 1013, central lens 1002 comprising inner electrode 1006, intermediate electrode 1007 and an outer electrode 1009. The electrode structure 1020 also comprises four annular electrodes 1047, 1048, 1049 and 1050. Inner electrode 1006, intermediate electrode 1007, outer electrode 1009 and annular electrodes 1047~1050 are illustratively concentric about the axis of symmetry 130. The conductive boundary wall 1060 extends axially between the radially-outer edge of the annular electrode 1046 of electrode structure 1010 and the radially-outer edge of the annular electrode 1050 of electrode structure 1020. The electrode structure 1020 illustratively comprises materials described above in connection with embodiments. Moreover, electrode structure 1020 is illustratively fabricated according to methods described above in connection with embodiments.

Figure 20A:
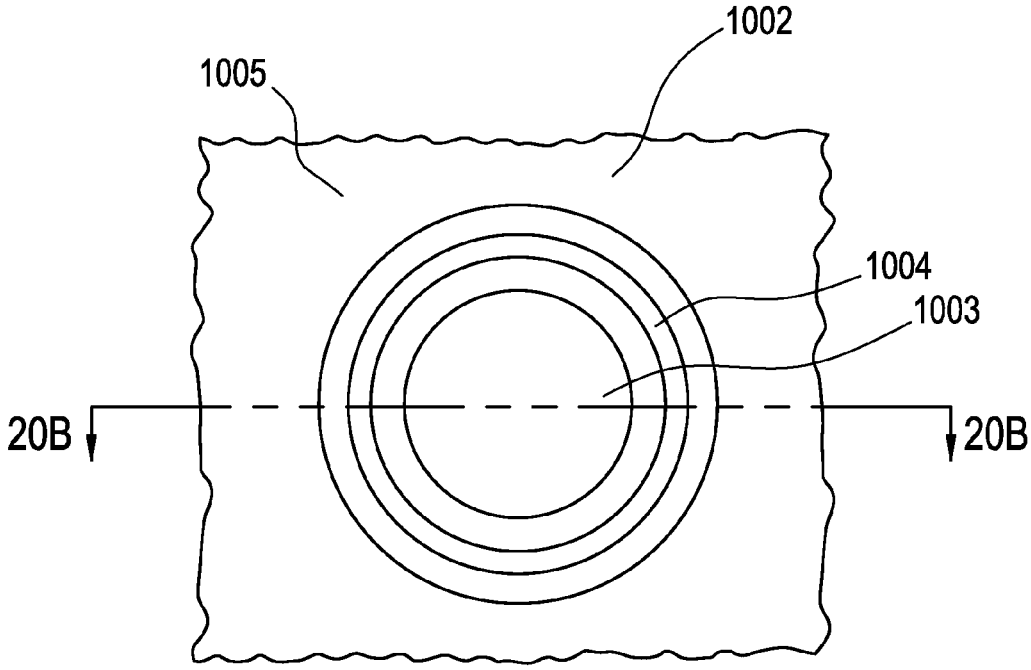
FIG. 20A is a top view of a central lens in accordance with a representative embodiment.
Figure 20B:
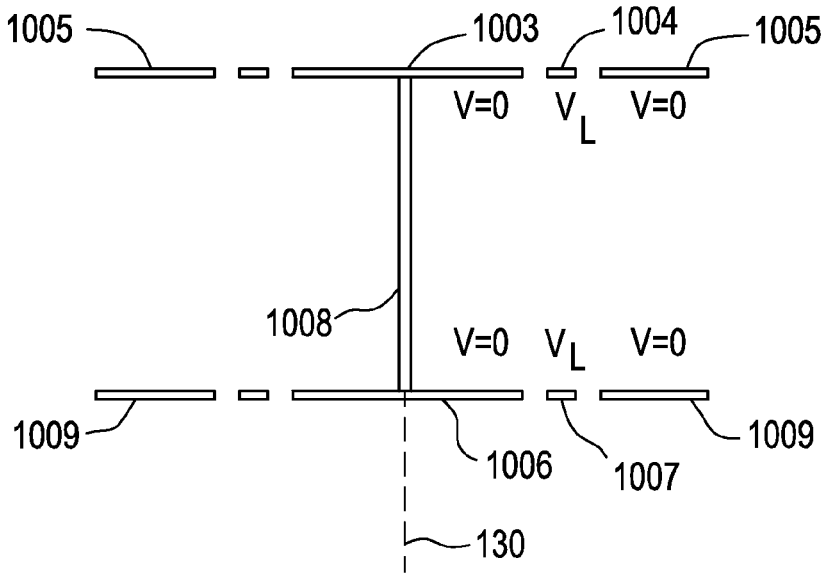
FIG. 20B is a cross-sectional view of the central lens of FIG. 20A taken along section line 20B-20B.

FIG. 20A shows a top view of a central lens 1002 of electrode structure 1010. For clarity of discussion, only a portion of the electrode structure 1010 is depicted to illustrate certain aspects of the central lens 1002. FIG. 20B is a cross-sectional view of the central lens of FIG. 20A taken along section line 20B-20B.

Central lens 1002 comprises two concentric electrode structures. As more clearly depicted in FIGS. 20A, 20B, the central lens 1002 comprises inner electrodes 1003, 1006, intermediate electrodes 1004, 1007, outer electrodes 1005, 1009 and electrically conductive post 1008 connecting the inner electrodes 1003, 1006. Outer electrodes 1005, 1009 surround the respective inner electrodes 1003, 1006 and respective intermediate electrodes 1004, 1007.

In a representative embodiment, the inner electrodes 1003, 1006 and the outer electrodes 1005, 1009 are maintained at nominal ground voltage (V=0). The intermediate electrodes 1004, 1007 of the central lens 1002 is held at a specified negative voltage ($V=V_L$).

Figure 21:
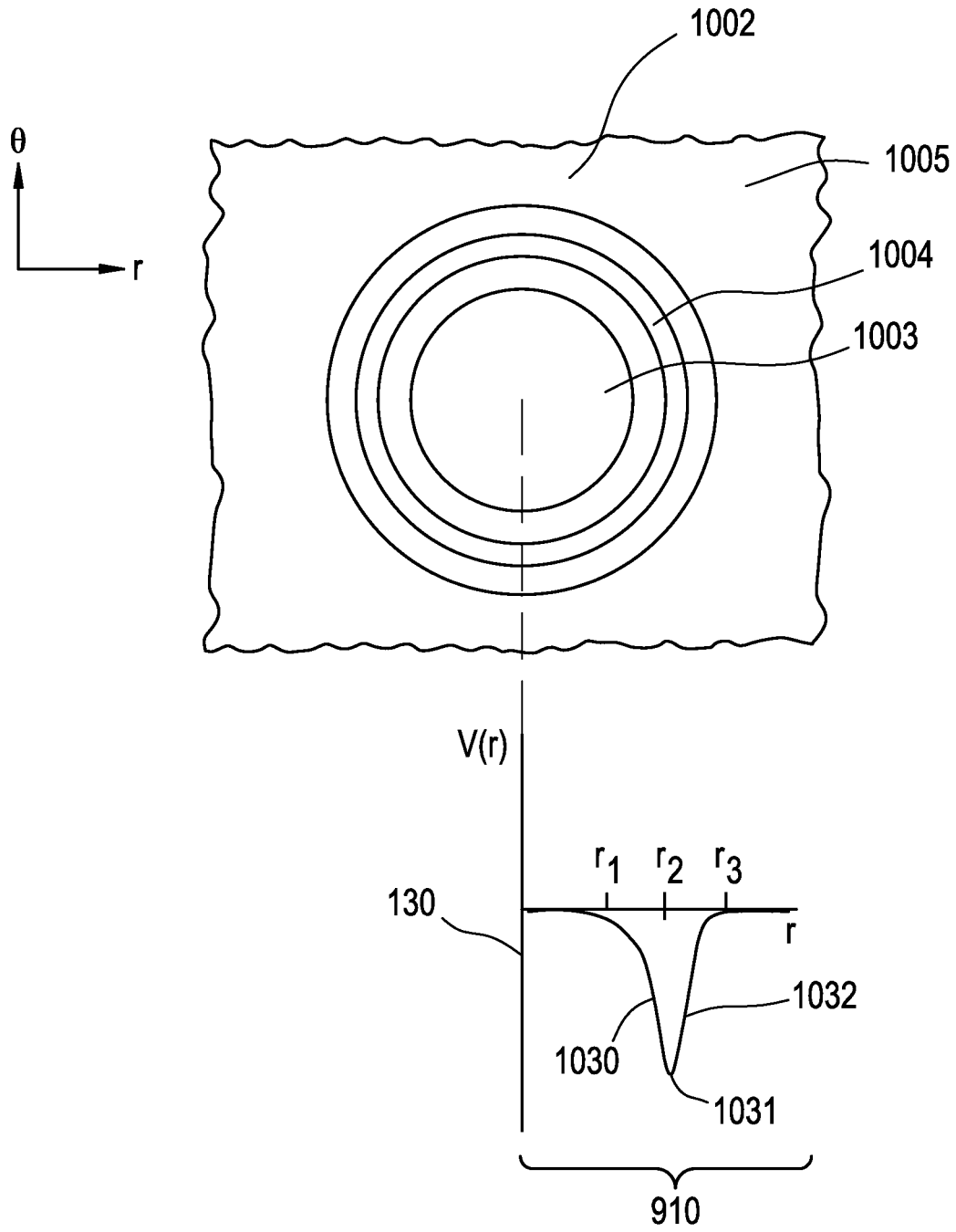
FIG. 21 is a top view of a central lens and the resultant radially-dependent electric potential in accordance with a representative embodiment.

The applied voltages and resultant exemplary electrostatic potential profile experienced by analyte ions traversing the central lens region 910 are shown in FIG. 21. In a first radial region 1030 the electric potential within the central lens region 910 decreases between approximately radii $r_1$ and $r_2$ to a minimum electric potential 1031. In a second radial region 1032 the electric potential increases from approximately radii $r_2$ and $r_3$, from the minimum electric potential 1031 to nullity. Field-free region 920 begins at radius $r_3$ as a result of the outer electrode 1005, which is maintained at nominal ground electric potential. From the shape of the potential profile, it is clear that ions traveling on a trajectory near the minimum electric potential 1031 will experience little deflection in the plane of mass analyzer 1001, whereas ions traveling on parallel trajectories displaced to either side of the potential minimum electric potential 1031 will experience a net electrostatic force attracting the ions toward the minimally deflected trajectory.

Figure 22:
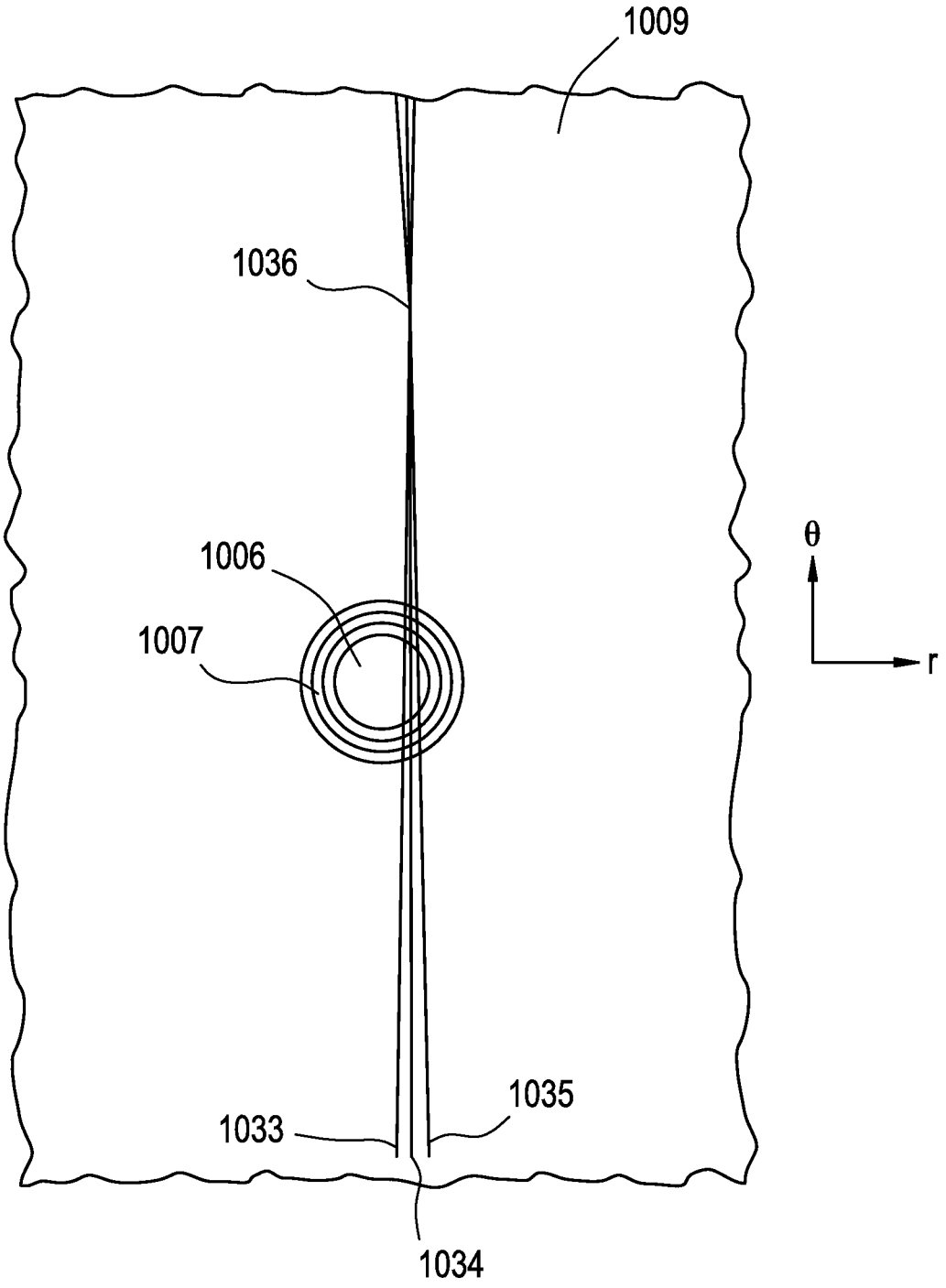
FIG. 22 is a top view showing calculated trajectories of ions of an ion packet in a mass analyzer comprising a central lens in accordance with a representative embodiment.

FIG. 22 shows a portion of mass analyzer 1001 and illustrates trajectories of ions traveling in the central lens region 910 with applied voltages set forth in FIG. 20B, which provide the electric potential profile shown in FIG. 21. For ease of description, components of electrode structure 1010 are not depicted, but rather those of electrode structure 1020 are shown. As ions travel in trajectories between electrode structure 1010 and electrode structure 1020, the partial representation facilitates the discussion of the trajectories.

The flight path of an ion traveling at a radius between r=0 and $r_2$ of FIG. 17 is depicted by trajectory 1033. Illustratively, the ion is traveling within the first radial region 1030 and experiences a net attractive toward the minimum electric potential 1031. As such the ion traveling along trajectory 1033 is directed in the positive r-direction by the electric field.

The flight path of an ion traveling at a radius of approximately $r_2$ of FIG. 17 is depicted by trajectory 1034. Illustratively, the ion is traveling at radius $r_2$ and experiences a substantially no net attractive force. As such the ion traveling along trajectory 1033 is undeflected by the electric field of the central lens 1002.

The flight path of an ion traveling at a radius between $r_2$ and $r_3$ of FIG. 17 is depicted by trajectory 1035. Illustratively, the ion is traveling within the second radial region 1032 and experiences a net attractive toward the minimum electric potential 1031. As such the ion traveling along trajectory 1033 is directed in the negative r-direction by the electric field.

The trajectories 1033~1035 spatially focus at focal point 1036, which is located in the field-free region 920. The ions traveling along these trajectories are then reflected in the minor region 930 and undergo a prescribed number of orbits before being incident on the ion detector (not shown in FIG. 22). The net result is an effective convergent ion lens in the r-Θ plane of the mass analyzer 1001 for an ion beam close enough to the minimum of the electrostatic potential profile that it is not deflected by the electric potential of the central lens 1002. Due to the cylindrical symmetry of the mass analyzer 1001 and conservation of angular momentum for the ion trajectories (if the small axial motion of the ions is ignored), each ion will maintain an unchanging distance-of-closest-approach to the axis of symmetry 130 for all orbits over the entire trajectory and an unchanging velocity at this closest-approach distance. As a result, the central lens 1002 acts as a periodic convergent lens element over the entire trajectory of each individual ion. As described more fully below, the converging characteristics of the central lens narrows the spread of the ion beam traversing the mass analyzer 1001, and in conjunction with the focusing provided in the minor region 930 reduces the lateral spread of the ion beam.

Figure 24:
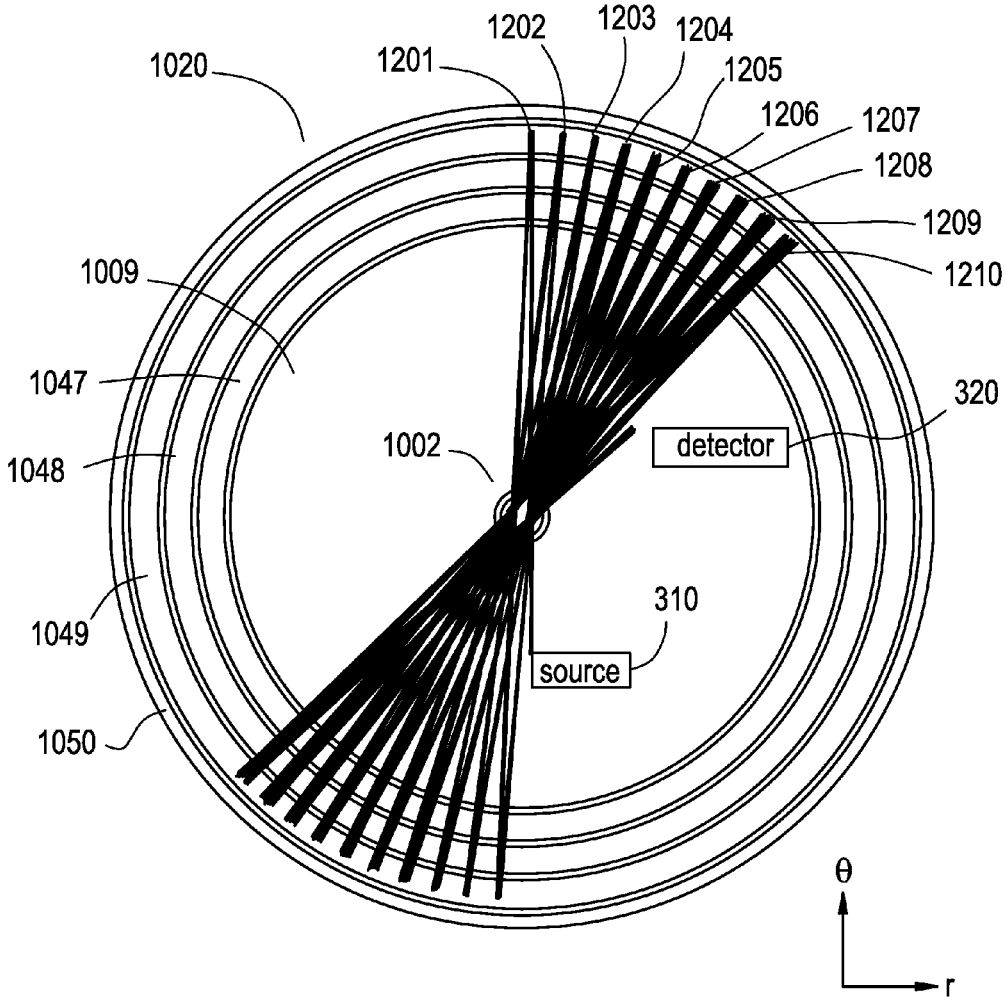
FIG. 24 is a top view showing calculated trajectories of ions in a mass analyzer comprising a central lens with inner electrodes maintained at a negative electric potential in accordance with a representative embodiment.

Beneficially, the voltage applied to the electrodes of the central lens 1002 is advantageously selected to have an effective focal length, that when coupled with the reflective and focusing properties of the electrodes of the mirror region 930, produces an optimally collimated ion beam in the r-Θ plane of the mass analyzer 1001. This collimation dynamic produced by the combined effects of the central lens 1002 and the lensing properties of the annular electrodes 1043-1050 is similar to other more conventional ion guiding systems. Specifically, in the completion of one orbit, an ion passes through the central lens 1002, the annular electrodes 1043~1050, the central lens 1002, and then the annular electrodes 1043~1050. As multiple orbits are concatenated to form a multi-orbit trajectory (e.g., as shown in FIG. 24 below), the ion has effectively passed through a periodic sequence of lenses. By the appropriate choices of lensing elements, stable and collimated beam transport can be produced.

Figure 23:
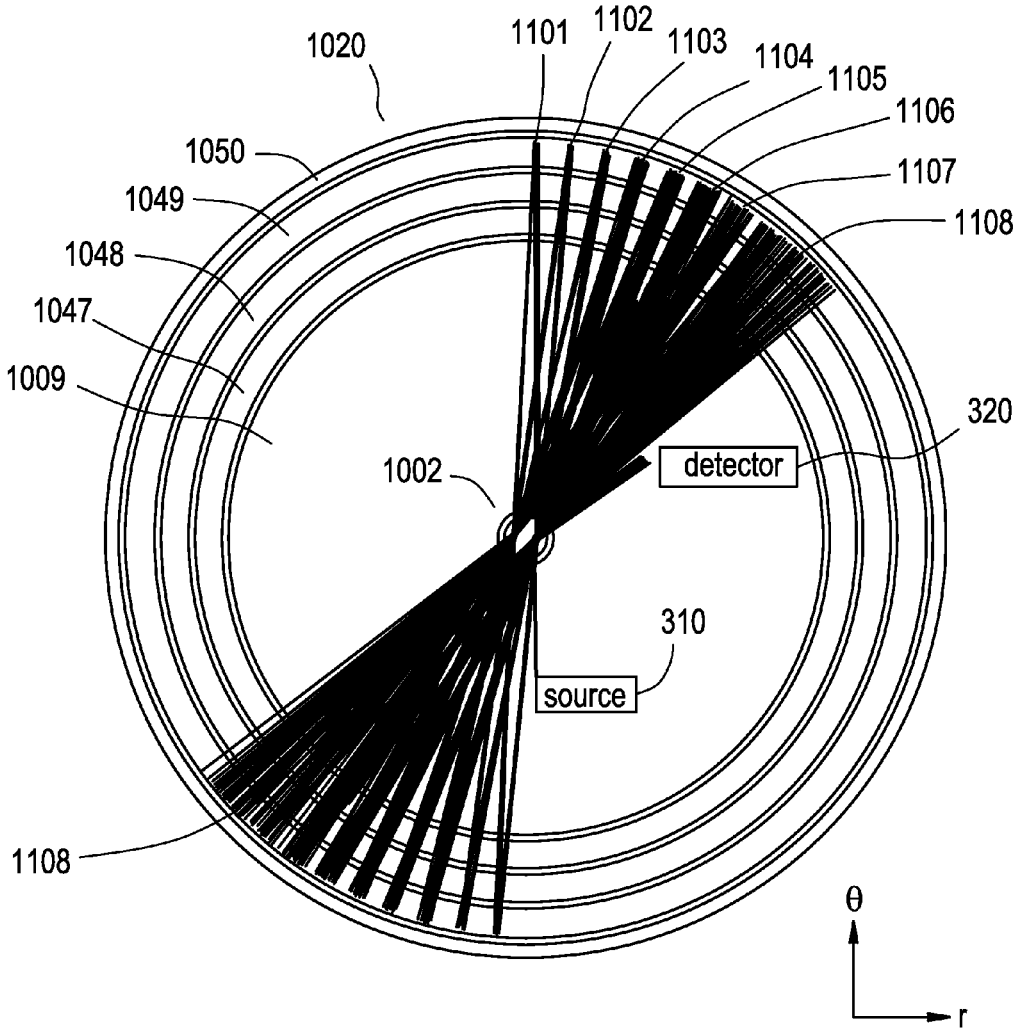
FIG. 23 is a top view showing calculated trajectories of ions in a mass analyzer comprising a central lens with electrodes maintained nominally at ground in accordance with a representative embodiment.

FIG. 23 shows a portion of mass analyzer 1001 and illustrates trajectories of ions traveling in the r-Θ plane of the mass analyzer 1001. For ease of description, components of electrode structure 1010 are not depicted, but rather those of electrode structure 1020 are shown. As ions travel in trajectories between electrode structure 1010 and electrode structure 1020, the partial representation facilitates the discussion of the ion trajectories.

In the presently described embodiment, no voltage is applied to the electrodes of the central lens 1002. However, voltages are applied to the annular electrodes 1046~1050 to provide the electric potential profile in the field-free region 920 and the mirror region 930 depicted in FIG. 17.

Ions from the source are reflected by the electric field in the mirror region 930 and follow orbits 1101, 1102, 1103, 1104, 1105, 1106 and 1107, which are discernable, but also experience increasing lateral spread in the r-Θ plane of the mass analyzer 1001. Trajectories generally depicted as 1108 comprise trajectories of three (3) orbits, which are not readily discerned due to the lateral spreading in the r-Θ plane of the mass analyzer 1001. Accordingly, ions with trajectories 1108 experience unacceptably lateral expansion resulting in flight time differences of ions between the ion source 310 and the ion detector 320. This increased later spread of ions of trajectories 1108 results in decreased analyzer resolution. The increased lateral spread of ions of trajectories 1108 may also cause a substantial number of the ions to completely miss the ion detector 320. Thus, the increased lateral beam spread results in decreased analyzer sensitivity. Finally, the increased lateral spread of the ions of trajectories 1108 may cause ion trajectories that correspond to different orbit numbers to overlap in the region of the detector. This would lead to spurious peaks occurring in the mass spectrum, as some ions would be detected before performing the prescribed number of orbits (e.g., 10 orbits). Thus, the increased lateral spread of ions of trajectories 1108 results in misidentification of ion species.

FIG. 24 shows a portion of mass analyzer 1001 and illustrates trajectories of ions traveling in the r-Θ plane of the mass analyzer 1001. For ease of description, components of electrode structure 1010 are not depicted, but rather those of electrode structure 1020 are shown. As ions travel in trajectories between electrode structure 1010 and electrode structure 1020, the partial representation facilitates the discussion of the ion trajectories.

In the presently described embodiment, negative voltage $V_L$ is applied to intermediate electrode 1004 (not shown in FIG. 24) and intermediate electrode 1007 of central lens 1002; and no voltage (V=0V) is applied to inner electrode 1003 (not shown in FIG. 24), to inner electrode 1006, or to outer electrode 1005 (not shown in FIG. 24), or to outer electrode 1009. Optimized voltage values are applied to the annular electrodes 1046~1050 to realize the electric potential profile in the field-free region 920 and the mirror region 930 depicted in FIG. 17.

Ion trajectories 1201~1210 representative of ten (10) orbits of ions from ion source 310 are depicted. As can be appreciated from a review of FIG. 24, the lateral spread of the ions traversing ion trajectories 1201~1210 in the r-Θplane of the mass analyzer 1001 is substantially reduced when compared to ion trajectories 1101~1108 depicted in FIG. 23. Beneficially, the selective application of voltages to the inner electrodes 1003, 1006, to the intermediate electrodes 1004, 1007, and to the outer electrodes 1005, 1009 of the central lens 1002 of mass analyzer 1001 significantly reduces the ion beam divergence, and can mitigate the deleterious effects on the performance metrics described above. In connection with an example below, the reduced lateral spread fosters increased analyzer resolution, sensitivity, and identification fidelity over that of an analyzer operated without the central lens 1002.

Example Parameters for Cylindrical Geometry TOF Mass Analyzer Comprising a Central Lens One beneficial aspect of the central lens 1002 is the ability to change the spatial focal point of ion trajectories, or to realize a diverging lens characteristic by applying a positive voltage to electrodes inner 1003, 1006 of the central lens 1002. The central lens is analyzed on two levels for incorporation into a cylindrical geometry TOF mass analyzer/mass spectrometer. The first analysis isolated the central lens 1002 with an in-plane (r-Θ) focal length dependent upon structural dimensions and applied voltage. Then, when incorporated into a cylindrical geometry TOF mass analyzer/mass spectrometer, these parameters can be further optimized to maximize the specified performance metrics of the mass spectrometer 1000.

Figure 25A:
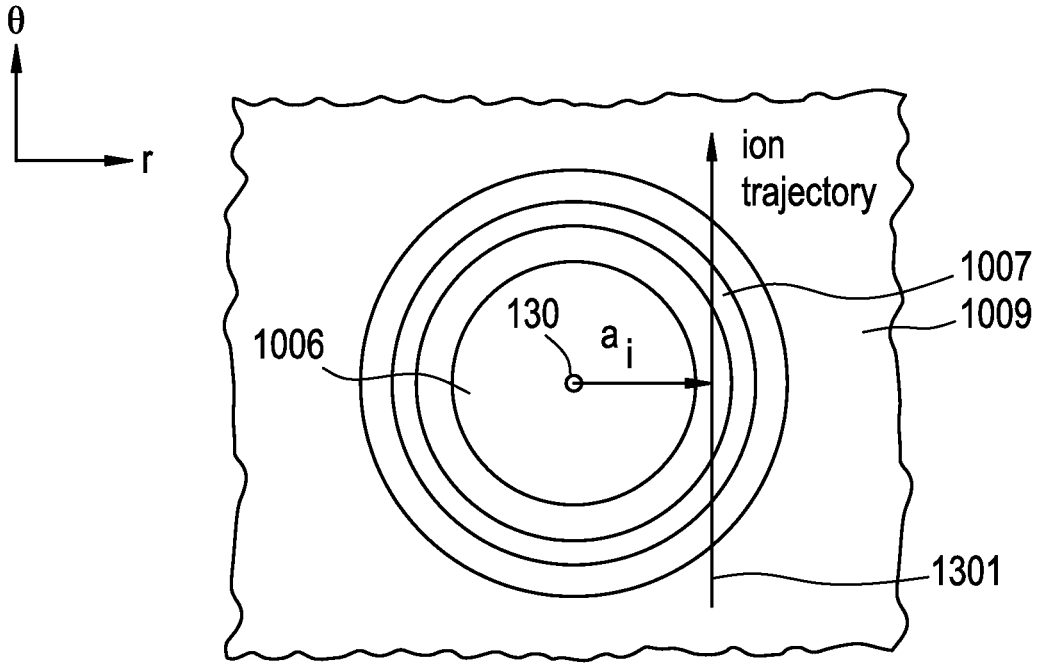
FIG. 25A shows a portion of a central lens of a representative embodiment.

FIG. 25A shows a portion of central lens 1002. For ease of description, components of electrode structure 1010 are not depicted, but rather those of electrode structure 1020 are shown. As ions travel in trajectories between electrode structure 1010 and electrode structure 1020, the partial representation facilitates the discussion of the trajectories. FIG. 25A depicts an illustrative trajectory 1301 of an ion that has an undeflected impact parameter (closest distance to the axis of symmetry 130) given by the ion beam impact parameter "$a_i$" The inner electrode 1006 and outer electrode 1009 (and inner electrode 1003 and outer electrode 1005 not shown in FIG. 25A) are at nominal ground voltage (V=0V), and the intermediate electrode 1007 (and intermediate electrode 1004 not shown in FIG. 25A) is maintained at (negative) voltage $V_L$.

Figure 25B:
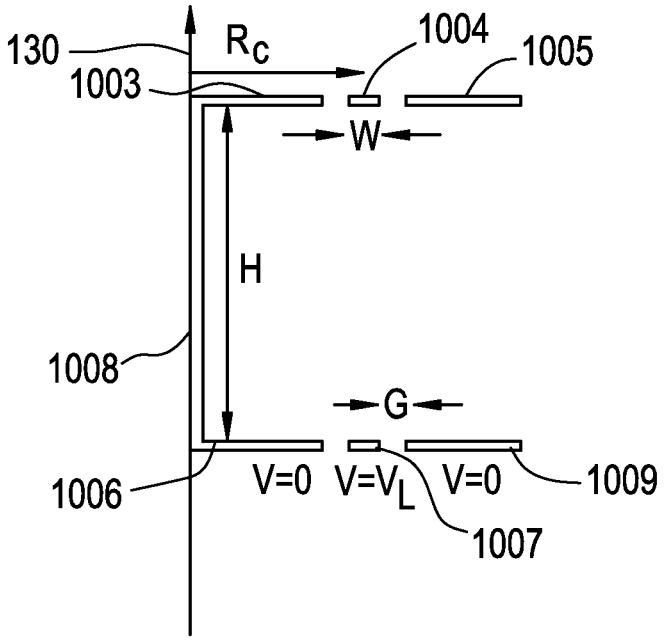
FIG. 25B shows a cross-sectional view of the central lens shown in FIG. 25A.

FIG. 25B shows a cross-sectional view of the central lens 1002. Notably one-half of the central lens 1002 is depicted. As with certain embodiments described above, the full cross-sectional view (e.g., as depicted in FIG. 20B) is obtained by rotating the half cross-sectional view shown in FIG. 25B one full rotation about axis of symmetry 130.

For the present example, the relevant physical dimensions are the radius ($R_c$) of the intermediate electrodes 1004, 1007, the width (W) of the intermediate electrodes 1004, 1007, the gap (G) between intermediate electrodes 1004, 1007 and outer electrodes 1005, 1009, respectively, the gap (G) between intermediate electrodes 1004, 1007 and inner electrodes 1003, 1006, and the height (H) of the electrically conductive post 1008. It is assumed that the outer electrodes 1005,1009 extend out to a radial distance substantially greater than the separation H, and the precise spatial extent of the outer electrode 1005,1009 does not impact the action of the central lens 1002 proximal to inner electrodes 1003,1006.

To determine parameters of central lens 1002 that generate an effective convergent ion lens in the symmetry plane (z=0), first the impact parameter of the center of the input ion beam must be specified. It is noted that in order for the central lens 1002 to function as a symmetric convergent lens, the center of the input ion beam must have its direction undeflected as it passes through the central lens region 910, and it travels near the effective minimum of the electrostatic potential defined in FIG. 21. In determining the appropriate structure for central lens 1002 for a given ion beam impact parameter $a_i$, the radius of the intermediate electrodes 1004, 1007, $R_c$, is an important design parameter. When $R_c$ is specified to yield an undeflected ion beam center trajectory, it is found that the deflection of this trajectory is only weakly dependant upon the other lens parameters. It is also noted that an additional benefit of having the lens designed for an undeflected beam center is that the time-of-flight through the lens is necessarily a local extremum with respect to impact parameter for the center trajectory, i.e.

$$\frac{dT}{da_i} = 0$$

where T is the time-of-flight through the central lens region 910. This has been shown analytically in the small-angle impulse approximation, and verified in the detailed numerical calculations described below. The fact that the time-of-flight of the beam center is a local extremum with respect to impact parameter is very valuable in time-of-flight mass analyzers, as it implies a relative resolution insensitivity to beam width in the symmetry plane.

As an exemplary illustration of the central lens 1002 of representative embodiments, ion trajectories through an isolated lens structure are numerically simulated using version 8.0.6 of SIMION® ion optics modeling program. The lens geometry is specified by $R_c$=23.3 mm, W=4.0 mm, G=4.0 mm and H=48.0 mm. The ion beam center is specified to have $a_i$=12.0 mm and is centered on the symmetry plane midway between the planes defined by the electrode structures 1010, 1020. For this example, all ions are of mass 1000 amu with a kinetic energy of 7000 eV.

Figure 25C:
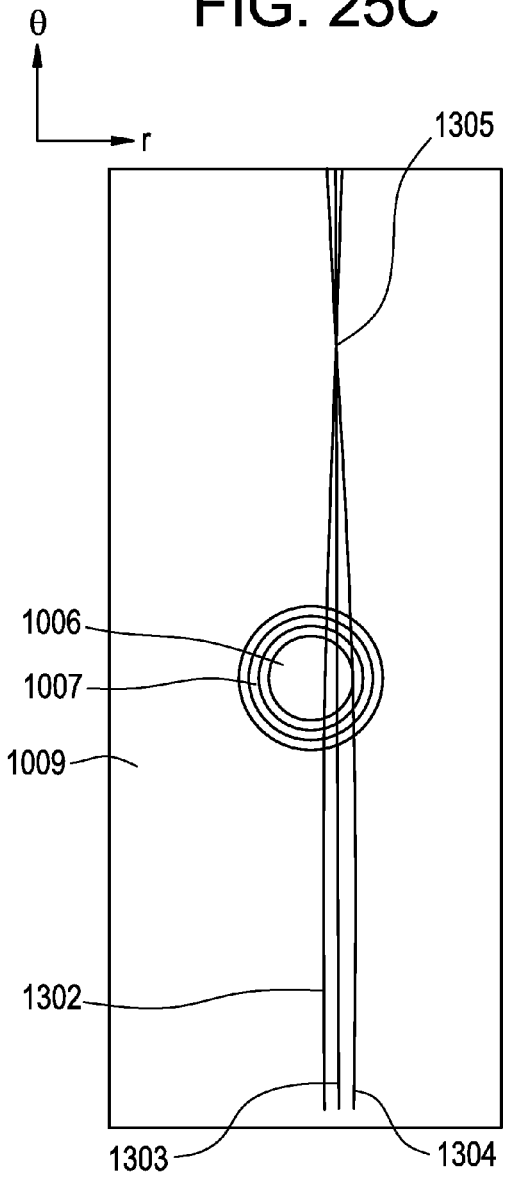
FIGS. 25C and 25D show simulated trajectories for an ion passing through a beam center of a central lens in accordance with a representative embodiment.
Figure 25D:
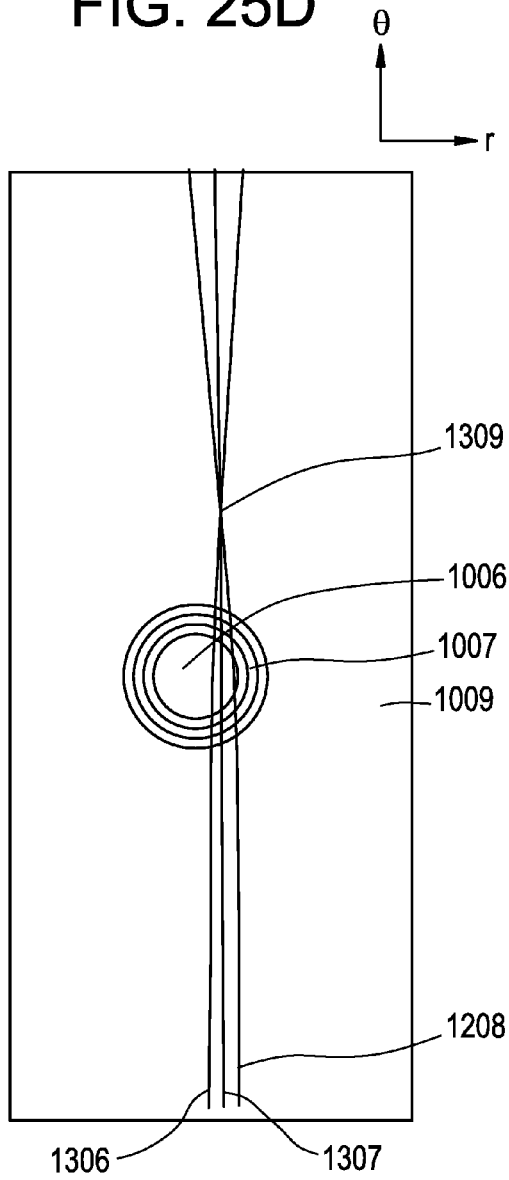

FIGS. 25C and 25D show simulated trajectories for an ion passing through the beam center, and two initially parallel ions at $a_i$=7.0 mm and $a_i$=17.0. In FIG. 25C, voltage $V_L$ is −5000 V. Ions traversing along trajectories 1302, 1303 and 1304 are spatially focused at spatial focal point 1305 at a distance of 160.1 mm.

In FIG. 25D, the voltage $V_L$ is −12000 V. Ions traversing along trajectories 1306, 1307 and 1308 are spatially focused at spatial focal point 1309 at a distance of 79.0 mm. Accordingly, the changing the voltage $V_L$ allows for tuning of the distance to the focal point of the central lens 1002.

It should be noted that although the disclosed structure acts as an efficient convergent ion lens in the plane defined by the electrodes, its behavior in the axial (z) dimension is quite different. Due to the form of the Laplace equation which governs electrostatic fields in charge-free regions, the existence of the in-plane convergent fields implies the existence of divergent fields in the axial dimension, much like a quadrupole deflector, which is known to one of ordinary skill in the art. For the lens specifications presented in the description of FIGS. 25C and 25D, the simulated focal lengths for the axial dimension are −156.3 mm and −77.7 mm, respectively. Notably, a negative focal length is indicative of a divergent lens. Accordingly, the structure of the central lens 1002 of embodiments described above provides the desired ion optic convergent behavior in the r-Θ plane of the mass analyzer 1001, but an attendant divergent behavior in the axial dimension. As will now be described in the example below, the convergent behavior of the central lens 1020 in the r-Θ plane and the divergent behavior of the central lens in the axial dimension advantageously satisfies the needs of the mass analyzer 1001 for in-plane ion beam focusing without compromising the ion dynamics in the axial dimension. This is possible due to the substantial degree of ion focusing power available in the axial dimension from the mirror structure of the mass analyzer 1001.

Returning to FIGS. 19A and 19B mass analyzer 1001 is constructed with the following illustrative dimensions:

Axial offset (height H of electrically conductive post 1008) between electrodes structures 1010, 1020 is set to 48.0 mm; inner radius of annular electrode 1043 is set to 363.0 mm; outer radius of annular electrode 1043 is set to 402.0 mm; inner radius of annular electrode 1044 is set to 405.0 mm; outer radius of annular electrode 1044 is set to 444.0 mm; inner radius of annular electrode 1045 is set to 447.0 mm; outer radius of annular electrode 1045 is set to 486.0 mm; and inner radius of annular electrode 1046 is set to 489.0 mm; and outer radius of annular electrode 1046 is set to 507.0 mm Notably, the inner and outer radii of the annular electrodes 1047~1050 of electrode structure 1020 are the same as their respective facing annular electrodes 1043~1046 of electrode structure 1010.

In addition, $R_c$=23.3 mm, W=4.0 mm, G=4.0 mm. The properties of the ion source 310 used in the simulations are: energy $E_0$=7000 eV; radial injection position $r_0$=12.0 mm, radial injection angle $\Theta_{r0}$=0°; axial injection position $z_0$=0.mm; axial injection angle $\Theta_{z0}$=0°; injection energy spread $\Delta E_0$=233.4 eV; radial injection position spread $\Delta r_0$=1.0 mm; radial injection angular spread $\Theta_{r0}$=0.40°; axial injection position spread $\Delta z_0$=1.0 mm; and axial injection angle spread $\Theta_{z0}$=0.02°. The center position of the ion detector 320 and orientation was adjusted to intercept ions after 10 full orbits and maximize the computed analyzer resolution.

In a first simulation using SIMION, no voltage is applied to the central lens 1002 (i.e., inner electrodes 1003, 1006, intermediate electrodes 1004, 1007 and outer electrodes 1005, 1009) are maintained at nominal ground voltage. Using a generic simplex optimization algorithm, familiar to those skilled in the art, the voltages applied to annular electrodes 1043~1046 and annular electrodes 1047~1050 voltages were adjusted to maximize the analyzer mass resolution (the primary performance metric). The voltages V1, V2, V3, V4 applied to annular electrodes 1043 and 1047, 1044 and 1048, 1045 and 1049, 1046 and 1050 were respectively, −12506.23 V, 162.8V, 6683.32V, 8765.05V.

In this embodiment where the central lens 1002 is maintained at nominal ground, the maximum resolution is 71,400. As described in connection with FIG. 23, the representative ion trajectories diverge dramatically in the r-Θ plane of mass analyzer 1001. The divergence is so great that many ions will be missed by the ion detector 320, leading to sensitivity loss. Additionally, some ions impact the ion detector 320 before performing the required number of orbits, leading to ion misidentification.

In another simulation using SIMION, the mass analyzer 1001 provides electrodes of the same configuration, the same illustrative dimensions, the same illustrative energy levels and energy spread as set forth in the description of FIGS. 19A and 19B above, a negative voltage $V_L$=4450.0V is applied to the intermediate electrodes 1004, 1007 of the central lens 1002. Inner electrodes 1003, 1006, electrically conductive post 1008, and outer electrodes 1005, 1009 of the central lens 1002 are maintained at nominal ground. Using a generic simplex optimization algorithm, familiar to those skilled in the art, the voltages applied to annular electrodes 1043~1046 and annular electrodes 1047~1050 voltages were adjusted to maximize the analyzer mass resolution (the primary performance metric). The voltages V1, V2, V3, V4 applied to annular electrodes 1043 and 1047, 1044 and 1048, 1045 and 1049, 1046 and 1050 were respectively, −12514.33 V, 136.82V, 6724.19V, 8824.64V.

The resolution of the mass analyzer is 253,000. The representative ion trajectories for this simulation are shown in FIG. 24. The operational advantages of incorporating the central lens 1020 with the mirror structure provided by annular electrode 1043~1046 and annular electrodes 1047~1050 are readily appreciated from a review of the ion trajectories 1201~1210 of the mass analyzer 1001. Along with a dramatic increase in the mass analyzer resolution, the analyte ion beam is collimated to a greater extent, leading to increased instrument sensitivity and a reduction in ion misidentification.

Figure 26:
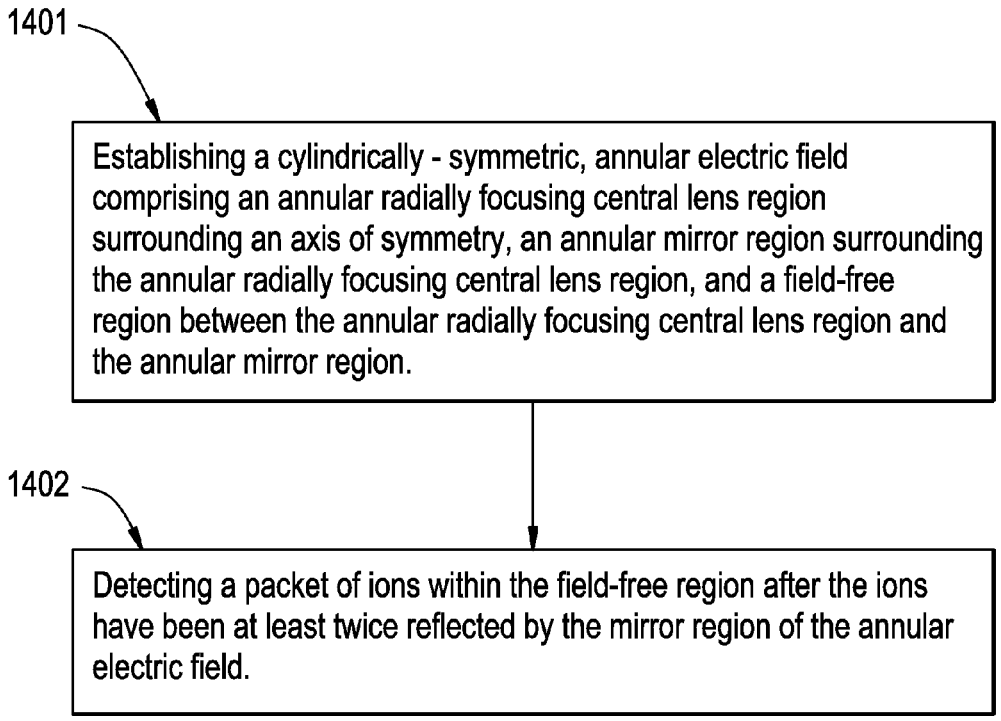
FIG. 26 is a flow chart showing an example of a mass spectrometry method in accordance with another representative embodiment.

FIG. 26 is a flow chart showing an example of a mass spectrometry method in accordance with another representative embodiment. Details of the structure and materials useful in effecting the method are described in connection with representative embodiments above.

At 1401, the method comprises establishing a cylindrically-symmetric, annular electric field comprising an annular radially focusing central lens region surrounding an axis of symmetry, an annular minor region surrounding the annular radially focusing central lens region, and a field-free region between the annular radially focusing central lens region and the annular mirror region.

At 1402, the method comprises detecting a packet of ions within the field-free region after the ions have been at least twice reflected by the mirror region of the annular electric field.

While example embodiments are disclosed herein, one of ordinary skill in the art appreciates that many variations that are in accordance with the present teachings are possible and remain within the scope of the appended claims. The invention therefore is not to be restricted except within the scope of the appended claims.

The invention claimed is:

1. A mass analyzer, comprising a pair of planar electrode structures, the electrode structures disposed opposite to each other, parallel to each other, and axially offset from each other, the electrode structures configured to generate, in response to an applied voltage, a cylindrically-symmetric, annular electric field comprising an annular radially focusing central lens region surrounding an axis of symmetry, and an annular mirror region surrounding the annular radially focusing central lens region.

2. A mass analyzer as claimed in claim 1, wherein the electric field further comprises a field-free region between the annular radially focusing central lens region and the annular mirror region.

3. A mass analyzer as claimed in claim 1, wherein an electric potential within the annular radially focusing central lens region decreases radially to a minimum in a first radial region.

4. A mass analyzer as claimed in claim 3, wherein an electric potential within the annular radially focusing central lens region increases radially from the minimum in a second radial region.

5. A mass analyzer as claimed in claim 1, wherein each of the electrode structures comprises annular electrodes radially offset from each other.

6. A mass analyzer as claimed in claim 5, further comprising electrical connections connected to apply the pattern of voltages to the annular electrodes of each of the electrode structures.

7. A mass analyzer as claimed in claim 5, wherein each of the electrode structures additionally comprises a respective substrate to which the annular electrodes are mechanically coupled.

8. A mass spectrometer, comprising:

an ion source;

a detector; and the mass analyzer as claimed in claim 1.

9. A mass spectrometer as claimed in claim 8, wherein the electric field further comprises a field-free region between the annular radially focusing central lens region and the annular mirror region.

10. A mass spectrometer as claimed in claim 8, wherein an electric potential within the annular radially focusing central lens region decreases radially to a minimum in a first radial region.

11. A mass spectrometer as claimed in claim 10, wherein an electric potential within the annular radially focusing central lens region increases radially from the minimum in a second radial region.

12. A mass spectrometer as claimed in claim 8, wherein each of the electrode structures comprises annular electrodes radially offset from each other.

13. A mass spectrometer as claimed in claim 12, further comprising electrical connections connected to apply the pattern of voltages to the annular electrodes of each of the electrode structures.

14. A mass spectrometer as claimed in claim 12, wherein each of the electrode structures additionally comprises a respective substrate to which the annular electrodes are mechanically coupled.

15. A mass spectrometry method, comprising:

establishing a cylindrically-symmetric, annular electric field comprising an annular radially focusing central lens region surrounding an axis of symmetry, an annular mirror region surrounding the annular radially focusing central lens region, and a field-free region between the annular radially focusing central lens region and the annular mirror region; and detecting a packet of ions within the field-free region after the ions have been at least twice reflected by the mirror region of the annular electric field.

16. A mass spectrometry method as claimed in claim 15, further comprising, after the establishing, directing the packet of ions from the field-free region towards the annular electric field.

17. A mass spectrometry method as claimed in claim 15, wherein the establishing further comprises establishing a radially-decreasing electric potential to a minimum electric potential in a first radial region of the annular radially focusing central lens region.

18. A mass spectrometry method as claimed in claim 15, wherein the establishing further comprises establishing a radially-increasing electric potential from the minimum in a second radial region of the annular radially focusing central lens region.

19. A mass analyzer comprising a pair of planar electrode structures, the electrode structures disposed opposite to each other, the electrode structures configured to generate, in response to an applied voltage, a cylindrically-symmetric, annular electric field comprising a lens region and a mirror region surrounding the lens region.

20. A mass spectrometer, comprising:

an ion source;

a detector; and the mass analyzer as claimed in claim 19.

* * * * *